US009327530B1

(12) United States Patent
Hara et al.

(10) Patent No.: US 9,327,530 B1
(45) Date of Patent: May 3, 2016

(54) PRINTER WITH DUPLEX PRINTING FUNCTION

(71) Applicant: RISO KAGAKU CORPORATION, Tokyo (JP)

(72) Inventors: Masashi Hara, Ibaraki (JP); Hideaki Inoue, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/952,385

(22) Filed: Nov. 25, 2015

(30) Foreign Application Priority Data

Nov. 27, 2014 (JP) ..... 2014-239946

(51) Int. Cl.
*B41J 29/38* (2006.01)
*B41J 13/00* (2006.01)
*B41J 3/60* (2006.01)

(52) U.S. Cl.
CPC ..... *B41J 13/0045* (2013.01); *B41J 3/60* (2013.01)

(58) Field of Classification Search
CPC ..... B41J 3/60; B41J 11/007; B41J 13/08; B41J 13/0045
See application file for complete search history.

(56) References Cited

U.S. PATENT DOCUMENTS 8,540,360 B2 * 9/2013 Nitta ..... B41J 3/60 347/102
2010/0002037 A1 1/2010 Kusuhata

FOREIGN PATENT DOCUMENTS

JP 2010-030296 2/2010

* cited by examiner

*Primary Examiner* — Juanita D Jackson
(74) *Attorney, Agent, or Firm* — Hamre, Schumann, Mueller & Larson, P.C.

(57) ABSTRACT

A controller is configured in duplex printing to: determine a reverse conveying speed corresponding to a printing schedule based on a printing condition; determine a switching timing corresponding to the printing schedule; and switch an operation of a common conveyer at the determined switching timing between a paper feeding conveying operation and a paper refeeding conveying operation. The paper feeding conveying operation is for receiving an unprinted sheet at a paper feeding conveying speed and conveying the unprinted sheet to a printing unit. The paper refeeding conveying operation is for receiving a sheet with a front side printed at the determined reverse conveying speed and conveying the sheet with the front side printed to the printing unit.

2 Claims, 8 Drawing Sheets

PRINTER WITH DUPLEX PRINTING FUNCTION

CROSS REFERENCE TO RELATED APPLICATION

This application is based upon and claims the benefit of priority from the prior Japanese Patent Application No. 2014-239946, filed on Nov. 27, 2014, the entire contents of which are incorporated herein by reference.

BACKGROUND

1. Technical Field

The disclosure relates to a printer with duplex printing function.

2. Related Art

Japanese Unexamined Patent Application Publication No. 2010-30296 describes a printer configured to perform duplex printing by: turning over sheets printed on the front sides while conveying the sheets; correcting skew of the sheets with registration rollers; conveying the sheets to a print mechanism such as an inkjet head; and performing printing on the back sides of the sheets.

As for such a printer, there is a demand for reducing the apparatus size. To meet this demand, there is a configuration in which common rollers double as conveying rollers for sending unprinted sheets to the registration rollers in feeding of the unprinted sheets, and as conveying rollers for sending the refed sheets to the registration rollers after the sheets are printed on the front sides and turned over. This can reduce the number of conveying rollers and reduce the apparatus size.

SUMMARY

In the configuration in which the common rollers double as the conveying rollers for paper feeding and the conveying rollers for paper refeeding as described above, while one of a paper feeding operation and a paper refeeding operation is performed, the other operation cannot be performed. Accordingly, the duplex printing may involve a waiting time of waiting for the completion of the operation of the conveying rollers and the productivity of printed matters may decrease.

An object of the disclosure is to provide a printer capable of suppressing decrease in the productivity of printed matters while achieving apparatus size reduction.

A printer in accordance with some embodiments includes: a printing unit configured to perform printing on a sheet while conveying the sheet based on a printing schedule; a circulation conveyer including a circulation route and configured in duplex printing to receive the sheet with a front side printed from the printing unit and convey the received sheet along the circulation route; a paper feeder including a paper feeding route for conveying an unprinted sheet, and a common conveyer configured to convey the unprinted sheet conveyed along the paper feeding route to the printing unit and convey the sheet with the front side printed conveyed along the circulation route to the printing unit; and a controller configured to control the printing unit, the paper feeder, and the circulation conveyer. The circulation route includes a section in which the sheet with the front side printed is conveyed at a reverse conveying speed and transferred to the common conveyer. The controller is configured in the duplex printing to: determine the reverse conveying speed corresponding to the printing schedule based on a printing condition; determine a switching timing corresponding to the printing schedule; and switch an operation of the common conveyer at the determined switching timing between a paper feeding conveying operation and a paper refeeding conveying operation, the paper feeding conveying operation being for receiving the unprinted sheet at a paper feeding conveying speed and conveying the unprinted sheet to the printing unit, the paper refeeding conveying operation being for receiving the sheet with the front side printed at the determined reverse conveying speed and conveying the sheet with the front side printed to the printing unit.

In the configuration described above, the paper feeding and the paper refeeding can be performed at timings corresponding to the printing schedule of the printing unit without a waiting time for completion of an operation of the common conveyer. As a result, decrease in the productivity of printed matters in the printing unit can be suppressed. Accordingly, the decrease in the productivity of printed matters can be suppressed while apparatus size reduction is achieved by use of the common conveyer.

The controller may be configured to switch from the paper feeding conveying operation to the paper refeeding conveying operation at a first timing at which the sheet with the front side printed is conveyed at the reverse conveying speed over a first distance corresponding to the reverse conveying speed after the sheet with the front side printed reaches a first position in the circulation route located upstream of the common conveyer. The controller may be configured to switch from the paper refeeding conveying operation to the paper feeding conveying operation at a second timing at which the unprinted sheet is conveyed at the paper feeding conveying speed over a second distance corresponding to the paper feeding conveying speed after the unprinted sheet reaches a second position in the paper feeding route located upstream of the common conveyer.

In the configuration described above, the operation of the common conveyer can be switched at timings corresponding to the reverse conveying speed and the paper feeding conveying speed without performing complex control.

DETAILED DESCRIPTION

Figure 1:
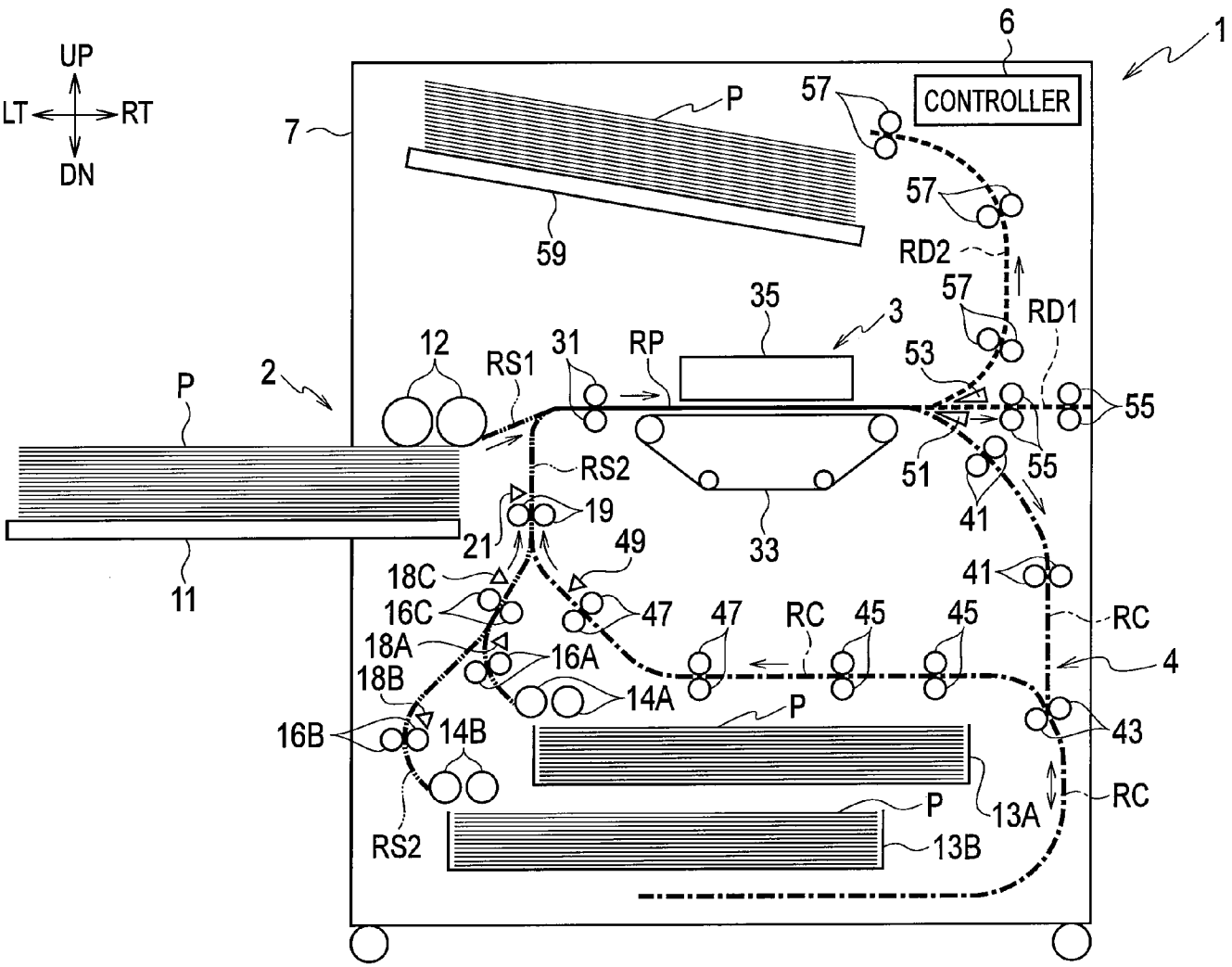
FIG. 1 is a schematic configuration diagram of a printer in an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
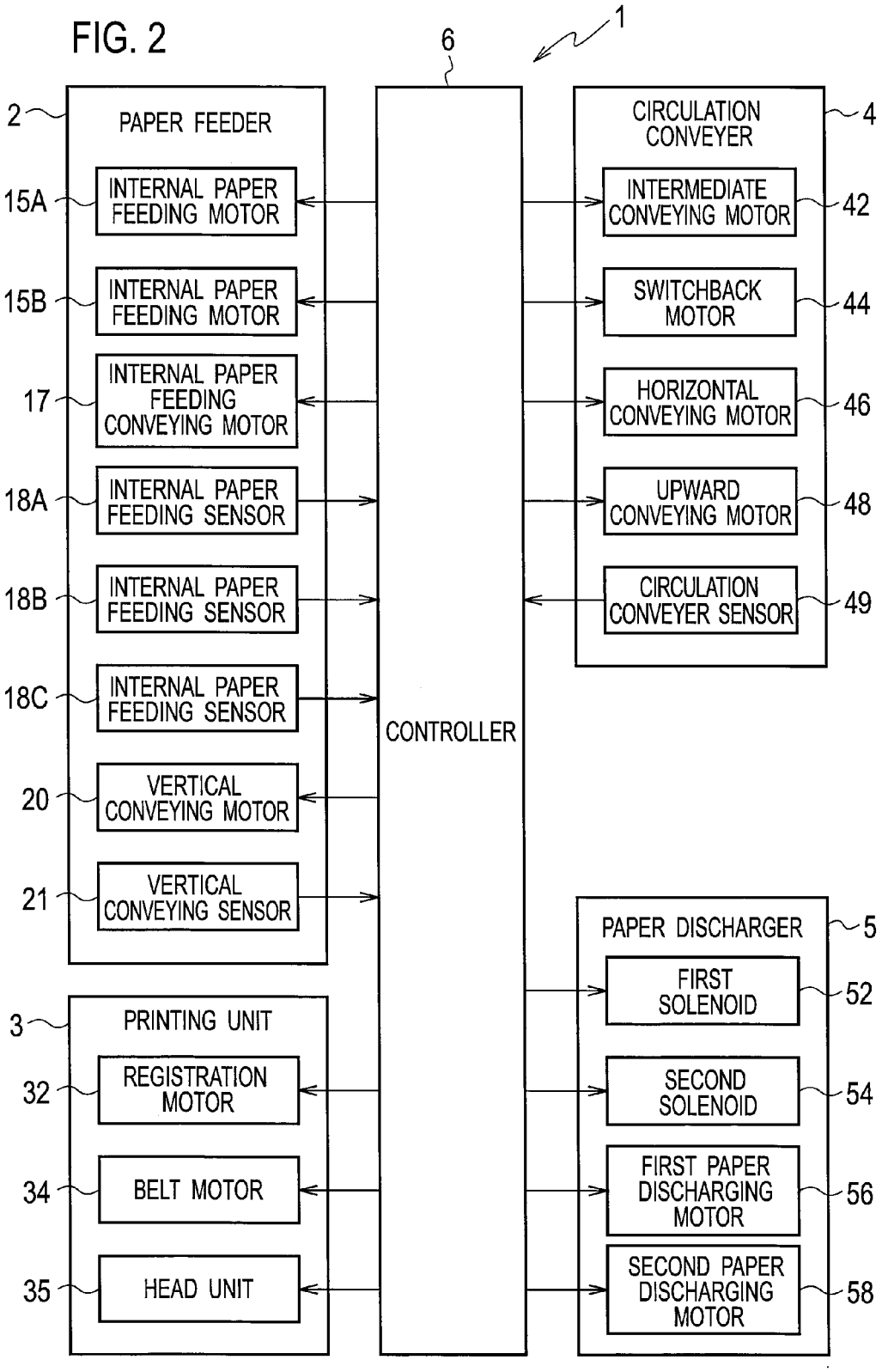
FIG. 2 is a control block diagram of the printer illustrated in FIG. 1.

FIG. 1 is a schematic configuration diagram of a printer in an embodiment. FIG. 2 is a control block diagram of the printer illustrated in FIG. 1. In the following description, directions orthogonal to the sheet surface of FIG. 1 are referred to as front-rear directions, and a direction toward the front side of the sheet is referred to as front. Moreover, in FIG. 1, directions of right, left, up, and down are denoted by RT, LT, UP, and DN, respectively.

A route illustrated by bold lines in FIG. 1 is a conveying route through which sheets being print media are conveyed. In the conveying route, a route illustrated by a solid line is a printing route RP, a route illustrated by one-dot chain lines is a circulation route RC, routes illustrated by broken lines are a first paper discharging route RD1 and a second paper discharging route RD2, and routes illustrated by two-dot chain lines are an external paper feeding route RS1 and an internal paper feeding route (paper feeding route) RS2. In the following description, upstream and downstream mean upstream and downstream in the conveying route.

As illustrated in FIGS. 1 and 2, a printer 1 of the embodiment includes a paper feeder 2, a printing unit 3, a circulation conveyer 4, a paper discharger 5, a controller 6, and a case 7 configured to house or hold the aforementioned units.

The paper feeder 2 feeds unprinted sheets P to the printing unit 3. Moreover, the paper feeder 2 refeeds the sheets P printed on front sides to the printing unit 3 in duplex printing. The paper feeder 2 is arranged upstream of all the other units in the conveying route. The paper feeder 2 includes an external paper feed tray 11, external paper feeding rollers 12, internal paper feed trays 13A and 13B, internal paper feeding rollers 14A and 14B, internal paper feeding motors 15A and 15B, internal paper feeding conveying rollers 16A to 16C, an internal paper feeding conveying motor 17, internal paper feeding sensors 18A to 18C, vertical conveying rollers (common conveyer) 19, a vertical conveying motor 20, and a vertical conveying sensor 21.

The external paper feed tray 11 is a tray on which the sheets P used for printing are stacked. The external paper feed tray 11 is installed to be partially exposed to the outside of the case 7.

The external paper feeding rollers 12 pick up the sheets P stacked on the external paper feed tray 11 one by one, and convey the sheets P along the external paper feeding route RS1 toward registration rollers 31 of the printing unit 3 to be described later.

The internal paper feed trays 13A and 13B are trays on which the sheets P used for printing are stacked. The internal paper feed trays 13A and 13B are arranged inside the case 7.

The pairs of internal paper feeding rollers 14A and 14B each pick up the sheets P stacked on a corresponding one of the internal paper feed trays 13A and 13B one by one.

The internal paper feeding motors 15A and 15B rotationally drive the pairs of internal paper feeding rollers 14A and 14B, respectively.

The internal paper feeding conveying rollers 16A and 16B convey the sheets P picked up from the internal paper feed trays 13A and 13B by the internal paper feeding rollers 14A and 14B, toward the internal paper feeding conveying rollers 16C. The internal paper feeding conveying rollers 16C convey each of the sheets P conveyed by the internal paper feeding conveying rollers 16A or the internal paper feeding conveying rollers 16B to the vertical conveying rollers 19. The internal paper feeding conveying rollers 16C are arranged downstream of a point where a portion of the internal paper feeding route RS2 extending from the internal paper feeding rollers 14A and a portion of the internal paper feeding route RS2 extending from the internal paper feeding rollers 14B merge.

The internal paper feeding conveying motor 17 rotationally drives the internal paper feeding conveying rollers 16A to 16C.

The internal paper feeding sensors 18A to 18C detect the sheets P picked up from the internal paper feed trays 13A and 13B and conveyed to the vertical conveying rollers 19. The internal paper feeding sensors 18A to 18C are arranged at predetermined positions downstream and near the pairs of internal paper feeding conveying rollers 16A to 16C, respectively.

The vertical conveying rollers 19 convey the sheets P conveyed from the internal paper feeding conveying rollers 16C along the internal paper feeding route RS2, to the registration rollers 31 of the printing unit 3 to be described later. Moreover, in duplex printing, the vertical conveying rollers 19 convey the sheets P printed on the front sides and conveyed and circulated along the circulation route RC, to the registration rollers 31. The vertical conveying rollers 19 are arranged along the internal paper feeding route RS2, downstream of a point where the circulation route RC merges with the internal paper feeding route RS2.

The vertical conveying motor 20 rotationally drives the vertical conveying rollers 19. Moreover, the vertical conveying motor 20 rotationally drives the external paper feeding rollers 12. The vertical conveying motor 20 is connected to each of the pair of the vertical conveying rollers 19 and the pair of the external paper feeding rollers 12 via a not-illustrated one-way clutch. Thus, the vertical conveying rollers 19 are rotationally driven by rotation drive of the vertical conveying motor 20 in one direction, whereas the external paper feeding rollers 12 are rotationally driven by rotation drive of the vertical conveying motor 20 in the other direction.

The vertical conveying sensor 21 detects the sheets P conveyed from the vertical conveying rollers 19 to the registration rollers 31. The vertical conveying sensor 21 is arranged at a predetermined position downstream and near the vertical conveying rollers 19.

The printing unit 3 prints images on the sheets P while conveying the sheets P. The printing unit 3 is arranged downstream of the paper feeder 2. The printing unit 3 includes the registration rollers 31, a registration motor 32, a belt conveyer 33, a belt motor 34, and a head unit 35.

The registration rollers 31 temporarily stop each of the sheets P conveyed by the external paper feeding rollers 12 or the vertical conveying rollers 19 to correct skew of the sheet P and then convey the sheet P toward the belt conveyer 33. The registration rollers 31 are arranged in the printing route RP in an upstream portion of the printing unit 3.

The registration motor 32 rotationally drives the registration rollers 31.

The belt conveyer 33 conveys the sheets P conveyed by the registration rollers 31 while sucking and holding the sheets P on a belt. The belt conveyer 33 is arranged downstream of the registration rollers 31.

The belt motor 34 drives the belt conveyer 33.

The head unit 35 has multiple line-type inkjet heads (not illustrated) in each of which multiple nozzles are arranged in a direction orthogonal to the conveying direction of the sheets P (front-rear directions). The head unit 35 is arranged above the belt conveyer 33. The head unit 35 prints images by ejecting inks from the nozzles of the inkjet heads onto the sheets P conveyed by the belt conveyer 33.

The circulation conveyer 4 conveys the sheets P printed on the front sides along the circulation route RC and transfers the sheets P to the vertical conveying rollers 19 in the duplex printing. The circulation conveyer 4 includes multiple pairs of intermediate conveying rollers 41, an intermediate conveying motor 42, switchback rollers 43, a switchback motor 44, multiple pairs of horizontal conveying rollers 45, a horizontal conveying motor 46, multiple pairs of upward conveying rollers 47, an upward conveying motor 48, and a circulation conveyer sensor 49.

The intermediate conveying rollers 41 convey the sheets P printed on the front sides, to the switchback rollers 43 in the duplex printing. The multiple pairs of intermediate conveying rollers 41 are arranged along a portion of the circulation route RC between the printing unit 3 and the switchback rollers 43.

The intermediate conveying motor 42 rotationally drives the multiple pairs of intermediate conveying rollers 41. Moreover, the intermediate conveying motor 42 rotationally drives the most upstream pair of first paper discharging rollers 55 and pairs of second paper discharging rollers 57 except for the most downstream pair of the second paper discharging rollers 57 to be described later.

The switchback rollers 43 switch back the sheets P conveyed by the intermediate conveying rollers 41 and convey the sheets P to the horizontal conveying rollers 45. The switchback rollers 43 are arranged downstream of the intermediate conveying rollers 41, in the circulation route RC.

The switchback motor 44 rotationally drives the switchback rollers 43.

The horizontal conveying rollers 45 convey the sheets P switched back by the switchback rollers 43, to the upward conveying rollers 47. The multiple pairs of horizontal conveying rollers 45 are arranged along an upstream portion of the circulation route RC between the pair of switchback rollers 43 and the point where the circulation route RC merges with the internal paper feeding route RS2.

The horizontal conveying motor 46 rotationally drives the multiple pairs of horizontal conveying rollers 45.

The upward conveying rollers 47 convey the sheets P conveyed by the horizontal conveying rollers 45 to the vertical conveying rollers 19. The multiple pairs of upward conveying rollers 47 are arranged along a downstream portion of the circulation route RC between the pair of switchback rollers 43 and the point where the circulation route RC merges with the internal paper feeding route RS2.

The upward conveying motor 48 rotationally drives the multiple pairs of upward conveying rollers 47.

The circulation conveyer sensor 49 detects the sheets P conveyed from the circulation conveyer 4 to the vertical conveying rollers 19. The circulation conveyer sensor 49 is arranged at a predetermined position downstream and near the most downstream pair of upward conveying rollers 47.

The paper discharger 5 discharges the printed sheets P. The paper discharger 5 includes a first switching part 51, a first solenoid 52, a second switching part 53, a second solenoid 54, the multiple pairs of first paper discharging rollers 55, a first paper discharging motor 56, the multiple pairs of second paper discharging rollers 57, a second paper discharging motor 58, and a paper receiving tray 59.

The first switching part 51 switches the conveying route of the sheets P from the first paper discharging route RD1 to the circulation route RC and vice versa. The first paper discharging route RD1 is a route extending from a downstream end of the printing route RP to a post-processing device (not illustrated) arranged to the right of the printer 1. The first switching part 51 is arranged at a branching point between the first paper discharging route RD1 and the circulation route RC.

The first solenoid 52 drives the first switching part 51.

The second switching part 53 switches the conveying route of the sheets P from the first paper discharging route RD1 to the second paper discharging route RD2 and vice versa. The second paper discharging route RD2 is a route which branches from the first paper discharging route RD1 at a position downstream of the branching point between the first paper discharging route RD1 and the circulation route RC and extends to the paper receiving tray 59. The second switching part 53 is arranged at a branching point where the second paper discharging route RD2 branches from the first paper discharging route RD1.

The second solenoid 54 drives the second switching part 53.

The first paper discharging rollers 55 discharge the sheets P conveyed from the printing unit 3, to the post-processing device. The multiple pairs of first paper discharging rollers 55 are arranged along the first paper discharging route RD1.

The first paper discharging motor 56 rotationally drives the first paper discharging rollers 55 except for the most upstream pair of first paper discharging rollers 55. The most upstream pair of first paper discharging rollers 55 is rotationally driven by the intermediate conveying motor 42.

The second paper discharging rollers 57 discharge the sheets P conveyed from the printing unit 3, to the paper receiving tray 59. The multiple pairs of second paper discharging rollers 57 are arranged along the second paper discharging route RD2.

The second paper discharging motor 58 rotationally drives the most downstream pair of second paper discharging rollers 57. The second paper discharging rollers 57 except for the most downstream pair of second paper discharging rollers 57 are rotationally driven by the intermediate conveying motor 42.

The paper receiving tray 59 is a tray on which the sheets P discharged by the second paper discharging rollers 57 are stacked. The paper receiving tray 59 is arranged at a downstream end of the second paper discharging route RD2.

The controller 6 controls operations of the units in the printer 1. The controller 6 includes a CPU, a RAM, a ROM, a hard disk drive, and the like.

In the case of performing the duplex printing, the controller 6 performs duplex printing of an interleaving method. The interleaving method is a method in which front sides of unprinted sheets P and back sides of sheets P printed on front sides are alternately printed while multiple sheets P are conveyed in the conveying route.

In the duplex printing of the interleaving method, the controller 6 controls the paper feeder 2 such that the feeding of the unprinted sheets P to the printing unit 3 and the refeeding of the sheets P printed on the front sides to the printing unit 3 are performed alternately.

In the case of performing the duplex printing by feeding the unprinted sheets P from the internal paper feed tray 13A or 13B, the controller 6 performs control of switching an operation of the vertical conveying rollers 19 of the paper feeder 2 between a paper feeding conveying operation and a paper refeeding conveying operation. The controller 6 controls (determines) timings of the switching depending on the printing schedule of the printing unit 3.

The paper feeding conveying operation of the vertical conveying rollers 19 is an operation in which the unprinted sheets are each received at a paper feeding conveying speed Vk and conveyed to the printing unit 3. The paper feeding conveying speed Vk is a conveying speed of the sheets P from the internal paper feed trays 13A and 13B to the vertical conveying rollers 19. The paper feeding conveying speed Vk is a fixed value set in advance.

The paper refeeding conveying operation of the vertical conveying rollers 19 is an operation in which the sheets P printed on the front sides and conveyed by the circulation conveyer 4 at a reverse conveying speed Vr are each received at the reverse conveying speed Vr and conveyed to the printing unit 3. The reverse conveying speed Vr is a conveying speed at which the sheets P switched back by the switchback rollers 43 are conveyed to the vertical conveying rollers 19 by the horizontal conveying rollers 45 and the upward conveying rollers 47. The circulation conveyer 4 conveys the sheets P at the reverse conveying speed Vr and transfers the sheets P to the vertical conveying rollers 19 in a section of the circulation route RC downstream of the switchback rollers 43. The reverse conveying speed Vr is set (determined) to a value corresponding to the printing schedule of the printing unit 3, based on printing conditions such as the sheet size, the sheet type, and the printing resolution.

Next, operations of the printer 1 in the simplex printing are described.

When the simplex printing is started, the unprinted sheets P are fed from the paper feeder 2 to the printing unit 3 one by one. In the printing unit 3, each of the sheets P abuts on the registration rollers 31 to be subjected to the skewing correction and is then conveyed to the belt conveyer 33 by the registration rollers 31 at a timing corresponding to a sheet length Lp, a sheet interval Lg, and a printing conveying speed Vg. Then, the sheet P is subjected to printing by using the inks ejected from the inkjet heads of the head unit 35 while being conveyed by the belt conveyer 33 at the printing conveying speed Vg.

The sheet length Lp is the length of the sheet P in the conveying direction. The sheet length Lp is a value determined based on the sheet size.

The sheet interval Lg is a distance between a trailing edge of a preceding sheet P and a leading edge of a following sheet Pin the belt conveyer 33. The shorter the sheet interval Lg is, the greater the number of sheets outputted per unit time is. In the embodiment, the sheet interval Lg is set to a smallest value achievable under the conditions such as the performance of the inkjet heads of the head unit 35, in order to achieve high productivity.

The printing conveying speed Vg is a conveying speed of the sheet P by the belt conveyer 33 in the printing by the printing unit 3. The printing conveying speed Vg is set based on the maximum number of drops for one pixel which is determined depending on the sheet type and the like, the printing resolution, and the like.

The sheet P subjected to printing in the printing unit 3 is discharged by the paper discharger 5. When the printed sheet P is to be discharged to the post-processing device, the printed sheet P is guided to the first paper discharging route RD1 by the first switching part 51 and the second switching part 53. Then, the sheet P is discharged to the post-processing device by the first paper discharging rollers 55. Meanwhile, when the printed sheet P is to be discharged to the paper receiving tray 59, the printed sheet P is guided to the second paper discharging route RD2 by the first switching part 51 and the second switching part 53. Then, the sheet P is discharged to the paper receiving tray 59 by the second paper discharging rollers 57.

A printing time Tps for one sheet in the printing unit 3 in the simplex printing as described above can be expressed by the following formula (1).

$$Tps=(Lp+Lg)/Vg \quad (1)$$

Since the printing is performed at the productivity of the printing time Tps for one sheet, the registration rollers 31 perform an operation of being activated every printing time Tps and stopped when conveying the sheet P by a distance corresponding to the sheet length Lp.

Next, control of feeding the sheets P from the internal paper feed trays 13A and 13B in the simplex printing is described.

Figure 3:
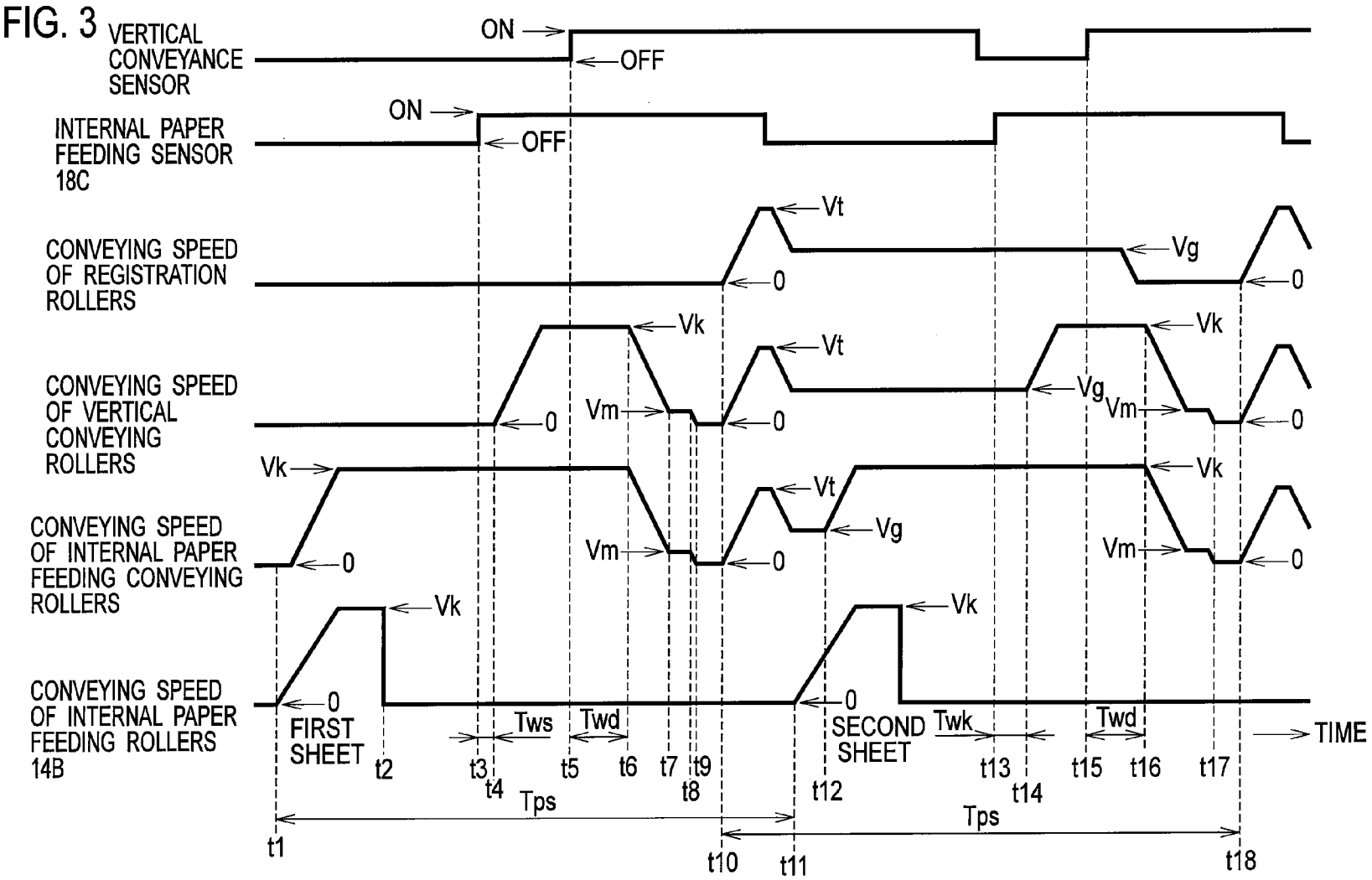
FIG. 3 is a timing chart for explaining control of feeding sheets from an internal paper feed tray in simplex printing.

Since the control is the same in both cases of feeding the sheets P from the internal paper feed tray 13A and feeding the sheet P from the internal paper feed tray 13B, description is given assuming that the sheets P are fed from the internal paper feed tray 13B. FIG. 3 is a timing chart for explaining the control of feeding the sheets P from the internal paper feed tray 13B in the simplex printing.

When the controller 6 receives a print job, the controller 6 causes the internal paper feeding motor 15B to activate the internal paper feeding rollers 14B at a time point t1 of FIG. 3 in order to feed the first sheet. Then, the controller 6 increases the conveying speed of the internal paper feeding rollers 14B to the paper feeding conveying speed Vk. The internal paper feeding rollers 14B thereby pick up the top sheet P from the internal paper feed tray 13B and conveys the sheet P at the paper feeding conveying speed Vk.

Moreover, after the internal paper feeding rollers 14B are activated, the controller 6 causes the internal paper feeding conveying motor 17 to activate the internal paper feeding conveying rollers 16A to 16C. Then, the controller 6 increases the conveying speed of the internal paper feeding conveying rollers 16A to 16C to the paper feeding conveying speed Vk and causes the internal paper feeding conveying rollers 16A to 16C to maintain the paper feeding conveying speed Vk. The internal paper feeding conveying rollers 16B receive the sheet P conveyed by the internal paper feeding rollers 14B at the paper feeding conveying speed Vk and convey the sheet P.

When the leading edge of the sheet P is detected by the internal paper feeding sensor 18B, the controller 6 stops the internal paper feeding rollers 14B at a time point t2 which is the time of the detection. Thereafter, the internal paper feeding rollers 14B rotate to follow the sheet P until the sheet P exits the internal paper feeding rollers 14B.

In this case, when the timing at which the sheet Preaches the internal paper feeding sensor 18B is delayed or advanced relative to a theoretical value, the controller 6 controls the internal paper feeding conveying motor 17 to correct the paper feeding conveying speed Vk.

Specifically, when the sheet P is delayed or advanced, the controller 6 changes the conveying speed of the internal paper feeding conveying rollers 16A to 16C from the paper feeding conveying speed Vk to a correction speed by using the internal paper feeding conveying motor 17. Then, when the leading edge of the sheet P is detected by the internal paper feeding sensor 18C, the controller 6 restores the conveying speed of the internal paper feeding conveying rollers 16A to 16C to the paper feeding conveying speed Vk. The correction speed is set to cancel out the delay or advance of the timing at which the sheet P reaches the internal paper feeding sensor 18B, before the sheet P reaches the internal paper feeding sensor 180 and the conveying speed of the internal paper feeding conveying rollers 16A to 16C is restored to the paper feeding conveying speed Vk.

The sheet P reaches the internal paper feeding conveying rollers 16C and the leading edge of the sheet P is detected by the internal paper feeding sensor 18C at a time point t3. At a time point t4, that is, upon elapse of an activation waiting time Tws from the time point t3, the vertical conveying motor 20 activates the vertical conveying rollers 19. Then, when the conveying speed of the vertical conveying rollers 19 reaches the paper feeding conveying speed Vk, the controller 6 causes the vertical conveying rollers 19 to maintain the paper feeding conveying speed Vk.

The activation waiting time Tws is expressed by the following formula (2).

$$Tws=(Lk-Vk^2/2\alpha u-Lkm)/Vk \quad (2)$$

In this formula, Lk is a distance between the internal paper feeding sensor 18C and the pair of the vertical conveying rollers 19 in the conveying route. $\alpha u$ is the acceleration of the vertical conveying rollers 19 in the case where the rollers 19 are accelerated, and is a fixed value. Lkm is a predetermined margin.

$Vk^2/2\alpha u$ in formula (2) is a conveying distance (acceleration distance) of the sheet P by the vertical conveying rollers 19 in a period when the vertical conveying rollers 19 are accelerated from a stopped state to the paper feeding conveying speed Vk at the acceleration $\alpha u$.

The activation waiting time Tws expressed by the formula (2) is a time required to convey the sheet P at the paper feeding conveying speed Vk over a distance obtained by subtracting the acceleration distance $Vk^2/2\alpha u$ and the margin Lkm from the distance Lk between the internal paper feeding sensor 18C and the pair of vertical conveying rollers 19. Accordingly, activating the vertical conveying rollers 19 at the time point t4, that is, upon elapse of the activation waiting time Tws from the time point t3 can cause the vertical conveying rollers 19 to reach the paper feeding conveying speed Vk at a time point where the leading edge of the sheet P is behind (upstream of) the vertical conveying rollers 19 by the margin Lkm. The vertical conveying rollers 19 are thus prepared to receive the sheet P conveyed at the paper feeding conveying speed Vk at the time point where the sheet P reaches the vertical conveying rollers 19.

When the sheet P reaches the vertical conveying rollers 19, the vertical conveying rollers 19 receive the sheet P at the paper feeding conveying speed Vk and convey the sheet P. The leading edge of the sheet P is detected by the vertical conveying sensor 21 at a time point t5. At a time point t6, that is, upon elapse of the paper feeding deceleration waiting time Twd from the time point t5, the controller 6 starts deceleration of the vertical conveying rollers 19.

The paper feeding deceleration waiting time Twd is expressed by the following formula (3).

$$Twd=(Lv-Vk^2/2|\alpha d|-Lm+Ltm)/Vk \quad (3)$$

In this formula, Lv is a distance between the vertical conveying sensor 21 and the pair of registration rollers 31 in the conveying route. $\alpha d$ is the acceleration of the vertical conveying rollers 19 in the case where the rollers 19 are decelerated, and is a fixed value. Lm is an abutting conveying distance. Ltm is a slack amount.

The abutting conveying distance Lm is a distance by which the sheet P is conveyed at an abutting conveying speed Vm to abut on the registration rollers 31 and form a slack for the skewing correction. The abutting conveying speed Vm is slower than the paper feeding conveying speed Vk. The abutting conveying distance Lm and the abutting conveying speed Vm are fixed values set in advance.

Figure 4:
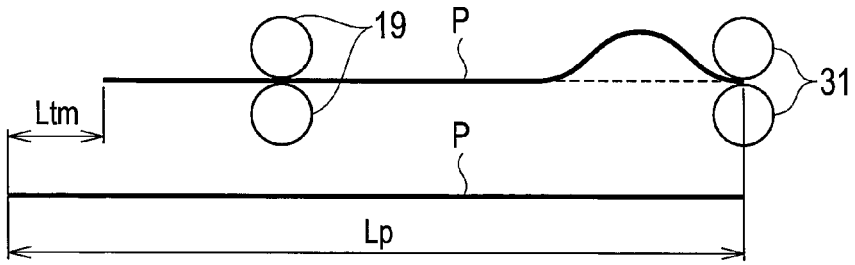
FIG. 4 is a view for explaining a slack amount.

The slack amount Ltm is a decrease amount from the sheet length Lp in the case where the sheet P abuts on the registration rollers 31 and a slack is formed as illustrated in FIG. 4. Note that, in FIG. 4, the registration rollers 31 and the vertical conveying rollers 19 are illustrated to be provided in a linear route for the convenience of description. The slack amount Ltm is a fixed value set to an appropriate amount in advance.

When the vertical conveying rollers 19 are decelerated and reaches the abutting conveying speed Vm at a time point t7 after the start of the deceleration at the time point t6, the controller 6 causes the vertical conveying rollers 19 to maintain the abutting conveying speed Vm until the sheet P is conveyed by the abutting conveying distance Lm from the time point t7.

When the conveying distance at the abutting conveying speed Vm reaches the abutting conveying distance Lm, at this time point which is a time point t8, the controller 6 starts deceleration of the vertical conveying rollers 19 to stop the rollers 19. Then, the vertical conveying rollers 19 are stopped at a time point t9.

Moreover, in a period from the time point t6 to the time point t9, the controller 6 causes the internal paper feeding conveying rollers 16A to 16C to operate in synchronization with the vertical conveying rollers 19 to assist the vertical conveying rollers 19.

$Vk^2/2|\alpha d|$ in the aforementioned formula (3) is a conveying distance (deceleration distance) of the sheet P by the vertical conveying rollers 19 in a period when the vertical conveying rollers 19 are decelerated and stopped from the paper feeding conveying speed Vk at the acceleration $\alpha d$. The total of the conveying distance of the sheet P by the vertical conveying rollers 19 in a period from the time point t6 to the time point t7 and the conveying distance in a period from the time point t8 to the time point t9 is equal to the deceleration distance $Vk^2/2|\alpha d|$. Accordingly, the conveying distance of the sheet P by the vertical conveying rollers 19 in a period from the start of deceleration at the time point t6 to the stop at the time point t9 is "$Vk^2/2|\alpha d|+Lm$."

The paper feeding deceleration waiting time Twd expressed by the formula (3) is a time required to convey the sheet P at the paper feeding conveying speed Vk over a distance obtained by subtracting "$Vk^2/2|\alpha d|+Lm$" described above from a distance equal to the sum of the slack amount Ltm and the distance Lv between the vertical conveying sensor 21 and the pair of registration rollers 31. Accordingly, starting the deceleration of the vertical conveying rollers 19 at the time point t6, that is, upon elapse of the paper feeding deceleration waiting time Twd from the time point t5 can cause the vertical conveying rollers 19 to stop in a state where the sheet P abuts on the registration rollers 31 with a slack of the slack amount Ltm formed in the sheet P.

After the sheet P abuts on the registration rollers 31 and is subjected to the skewing correction, at a time point t10, the controller 6 causes the registration motor 32 to activate the registration rollers 31. After the activation of the registration rollers 31, the controller 6 increases the conveying speed of the registration rollers 31 to a top speed Vt, causes the registration rollers 31 to maintain the top speed Vt for a predetermined time, and then reduces the conveying speed to the printing conveying speed Vg. Then, the controller 6 causes the registration rollers 31 to maintain the printing conveying speed Vg. The controller 6 decelerates the registration rollers 31 to the printing conveying speed Vg before the leading edge of the sheet P reaches the belt conveyer 33. Note that the top speed Vt is a fixed value set in advance.

Moreover, the controller 6 activates the vertical conveying rollers 19 and the internal paper feeding conveying rollers 16A to 16C at the time point t10 to assist the registration rollers 31. Thereafter, the controller 6 accelerates the vertical conveying rollers 19 and the internal paper feeding conveying rollers 16A to 16C to the top speed Vt and decelerates the rollers 19 and the rollers 16A to 16C to the printing conveying speed Vg in synchronization with the registration rollers 31.

At a time point t11 which is a paper feeding start timing for the second sheet, the controller 6 activates the internal paper feeding rollers 14B. The operation of the internal paper feeding rollers 14B after the activation is similar to that in the feeding of the first sheet. The paper feeding start timings of the second and subsequent sheets are determined depending on the activation timings of the registration rollers 31. As described above, the registration rollers 31 are activated every printing time Tps.

After the activation of the internal paper feeding rollers 14B, at a time point t12, the controller 6 starts the acceleration of the internal paper feeding conveying rollers 16A to 16C from the printing conveying speed Vg. The controller 6 increases the conveying speed of the internal paper feeding conveying rollers 16A to 16C to the paper feeding conveying speed Vk, and causes the internal paper feeding conveying rollers 16A to 16C to maintain the paper feeding conveying speed Vk. The internal paper feeding conveying rollers 16B receive the second sheet P conveyed by the internal paper feeding rollers 14B at the paper feeding conveying speed Vk and convey the sheet P.

When the timing at which the sheet P reaches the internal paper feeding sensor 18B is delayed or advanced relative to the theoretical value, the controller 6 corrects the paper feeding conveying speed Vk as in the aforementioned case of the first sheet.

When the sheet P reaches the internal paper feeding conveying rollers 16C and the leading edge of the sheet P is detected by the internal paper feeding sensor 18C at a time point t13, the controller 6 starts the acceleration of the vertical conveying rollers 19 from the printing conveying speed Vg at a time point t14, that is, upon elapse of a paper feeding acceleration waiting time Twk from the time point t13. Then, when the conveying speed of the vertical conveying rollers 19 reaches the paper feeding conveying speed Vk, the controller 6 causes the vertical conveying rollers 19 to maintain the paper feeding conveying speed Vk.

The paper feeding acceleration waiting time Twk is expressed by the following formula (4).

$$Twk=(Lk-(Vk^2-Vg^2)/2\alpha u-Lkm)/Vk \quad (4)$$

$(Vk^2-Vg^2)/2\alpha u$ in the formula (4) is a conveying distance (acceleration distance) of the sheet P by the vertical conveying rollers 19 in a period when the vertical conveying rollers 19 are accelerated from the printing conveying speed Vg to the paper feeding conveying speed Vk at the acceleration $\alpha u$.

The paper feeding acceleration waiting time Twk expressed by the formula (4) is a time required to convey the sheet P at the paper feeding conveying speed Vk over a distance obtained by subtracting the acceleration distance $(Vk^2-Vg^2)/2\alpha u$ and the margin Lkm from the distance Lk between the internal paper feeding sensor 18C and the pair of vertical conveying rollers 19. Accordingly, starting the acceleration of the vertical conveying rollers 19 at the time point t14, that is, upon elapse of the paper feeding acceleration waiting time Twk from the time point t13 can cause the vertical conveying rollers 19 to reach the paper feeding conveying speed Vk at a time point where the leading edge of the sheet P is behind (upstream of) the vertical conveying rollers 19 by the margin Lkm. The vertical conveying rollers 19 are thus prepared to receive the sheet P conveyed at the paper feeding conveying speed Vk at a time point where the second sheet P reaches the vertical conveying rollers 19.

When the sheet P reaches the vertical conveying rollers 19, the vertical conveying rollers 19 receive the sheet P at the paper feeding conveying speed Vk and convey the sheet P. The leading edge of the sheet P is detected by the vertical conveying sensor 21 at a time point t15. At a time point t16, that is, upon elapse of the paper feeding deceleration waiting time Twd from the time point t15, the controller 6 starts deceleration of the vertical conveying rollers 19 and the internal paper feeding conveying rollers 16A to 16C. Thereafter, the vertical conveying rollers 19 and the internal paper feeding conveying rollers 16A to 16C are stopped at a time point t17 by operations similar to those performed in the aforementioned period from the time point t6 to the time point t9.

Meanwhile, the controller 6 stops the registration rollers 31 at a timing at which the first sheet P exits the registration rollers 31.

Then, the controller 6 activates the registration rollers 31 to send the second sheet P to the belt conveyer 33, at a time point t18, that is, upon elapse of the printing time Tps from the activation timing (time point t10) of the registration rollers 31 for the feeding of the first sheet. Moreover, along with this, the controller 6 also activates the vertical conveying rollers 19 and the internal paper feeding conveying rollers 16A to 16C. Thereafter, operations in a period from the time point t10 to the time point t18 is repeated. However, in the feeding of the last sheet P, when the internal paper feeding sensor 18C detects the trailing edge of the sheet P, the controller 6 stops the internal paper feeding conveying rollers 16A to 16C. Moreover, when the vertical conveying sensor 21 detects the trailing edge of the sheet P, the controller 6 stops the vertical conveying rollers 19.

When the sheets P are fed from the external paper feed tray 11, the controller 6 causes the external paper feeding rollers 12 to pick up and convey the sheets P from the external paper feed tray 11. Then, the controller 6 controls the external paper feeding rollers 12 such that each of the sheets P abuts on the registration rollers 31 at the abutting conveying speed Vm and stops with a slack of the slack amount Ltm formed therein.

Thereafter, the controller 6 starts an assisting operation of the external paper feeding rollers 12 with the activation of the registration rollers 31. Specifically, the controller activates the external paper feeding rollers 12 and the registration rollers 31 simultaneously and accelerates the external paper feeding rollers 12 at a smaller acceleration than that of the registration rollers 31. This gradually reduces the slack in the sheet P while the sheet P is conveyed. Then, the controller 6 starts deceleration of the external paper feeding rollers 12 at a timing at which the slack of the sheet P is absorbed, and then stops the external paper feeding rollers 12. The assisting operation is thereby completed. Since the external paper feeding rollers 12 are configured to convey the sheet P while picking up the sheet P from the external paper feed tray 11, the controller 6 performs control such that the assisting operation is completed before the trailing edge of the sheet P exits the external paper feeding rollers 12, to prevent erroneous pick up of the next sheet P.

Next, the printing schedule of the printing unit 3 in the duplex printing is described.

Figure 5:
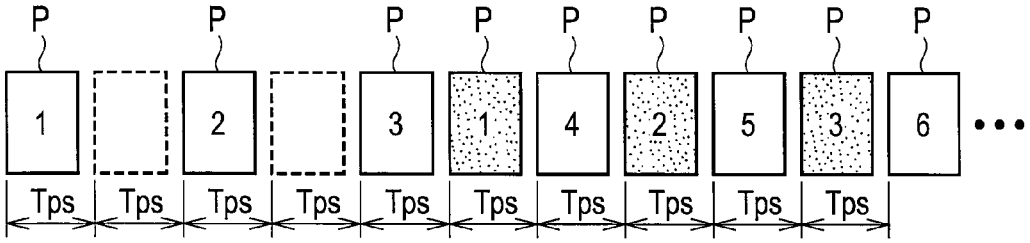
FIG. 5 is a view explaining a printing schedule of a printing unit in duplex printing.

The printing schedule of the printing unit 3 in the duplex printing is a schedule for achieving productivity for one side equivalent to that in the simplex printing, in the interleaving method. Specifically, as shown in FIG. 5, in the printing schedule in the duplex printing, the front-side printing and the back-side printing are performed alternately with one side printed in the printing time Tps. Note that, in FIG. 5, the numbers inside the sheets P indicate the order of the sheets. Moreover, white sheets P are sheets to be printed on the front sides and sheets P shaded by dots are sheets to be printed on the back sides.

Note that, until the first sheet P printed on the front side is refed and subjected to the back-side printing, the front-side printing is consecutively performed. In this period, as illustrated in FIG. 5, a gap of the printing time Tps for one sheet is generated between the printing of the preceding sheet P and the printing of the following sheet P. Moreover, after the front-side printing of the last sheet P, the back-side printing is consecutively performed. Also in this period, a gap of the printing time Tps for one sheet is generated between the printing of the preceding sheet P and the printing of the following sheet P. Accordingly, the productivity for one side equivalent to that in the simplex printing is substantially achieved in a period when the front-side printing and the back-side printing are alternately performed.

Next, a method of calculating the reverse conveying speed Vr is described.

The reverse conveying speed Vr is calculated to satisfy a condition that a time of one cycle from the activation timing of the registration rollers 31 in the paper feeding to the activation timing of the registration rollers 31 in the paper refeeding after the front-side printing in the duplex printing is equal to (2N−1) times the printing time Tps.

N is a one-side consecutive number. The one-side consecutive number N is the number of sheets printed on the front sides consecutively before the refed first sheet is printed on the back side. To put it differently, the one-side consecutive number N is the number of sheets printed on the back sides consecutively after the last sheet P is printed on the front side. The one-side consecutive number N is determined based on the sheet length Lp corresponding to the sheet size. In the example of FIG. 5, N is 3. Since 2N−1=5 is satisfied in this case, setting the time of one cycle to 5 Tps allows the back-side printing of the first sheet to be performed between the front-side printing of the third sheet and the front-side printing of the fourth sheet as illustrated in FIG. 5. The front-side printing and the back-side printing are thus alternately performed after the front-side printing of the third sheet with the printing for one side performed in the printing time Tps.

Figure 6:
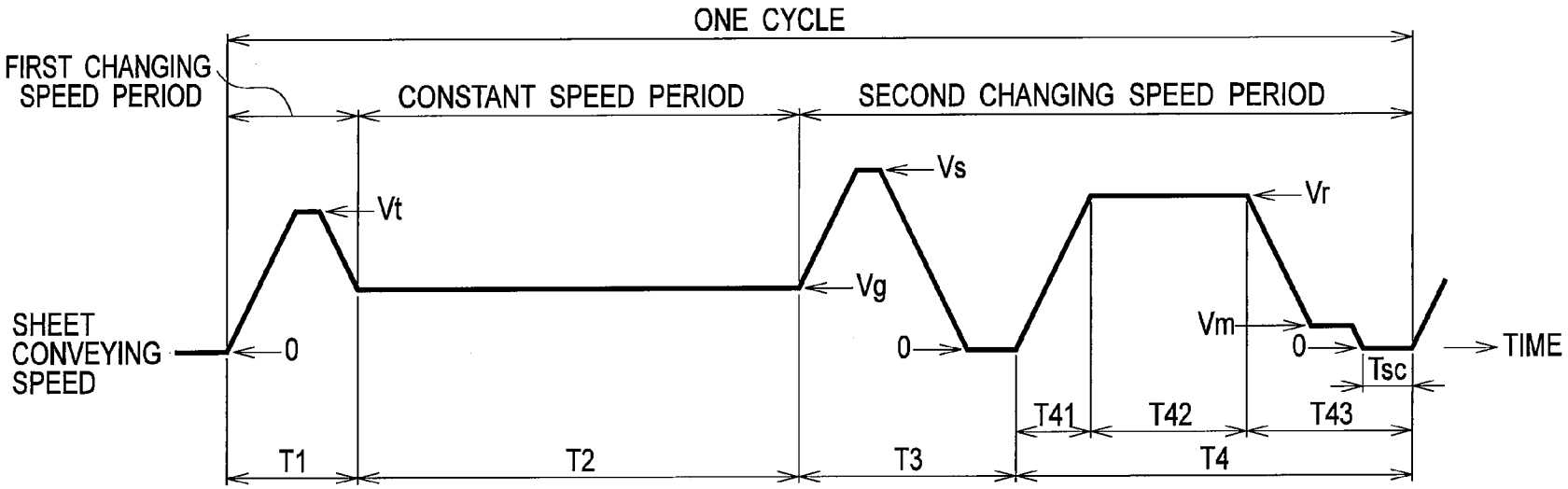
FIG. 6 is a view illustrating changes in a conveying speed of a sheet in the duplex printing.

Change in the conveying speed of the sheet P in one cycle is illustrated in FIG. 6. As illustrated in FIG. 6, one cycle can be divided into a first changing speed period, a constant speed period, and a second changing speed period.

The first changing speed period is a period from a time point where the registration rollers 31 are activated in the paper feeding from the paper feeder 2 to a time point where the conveying speed of the registration rollers 31 is reduced to the printing conveying speed Vg after being increased to the top speed Vt. Note that operations of the registration rollers 31 in the duplex printing are the same as the operations thereof in the simplex printing illustrated in FIG. 3.

At a starting point of the first changing speed period, the sheet P abuts on the registration rollers 31 and is stopped with a slack formed therein. In the first changing speed period, the registration rollers 31 start the conveyance of the sheet P and are accelerated to the top speed Vt. Then, the registration rollers 31 are decelerated to the printing conveying speed Vg.

The constant speed period is a period in which the sheet P is conveyed at a constant speed of the printing conveying speed Vg. In the constant speed period, the registration rollers 31, the belt conveyer 33, and the intermediate conveying rollers 41 convey the sheet P at the printing conveying speed Vg. Moreover, the inks are ejected from the head unit 35 to the sheet P conveyed by the belt conveyer 33 and an image is printed.

The second changing speed period is a period from a time point where the sheet P exits the most downstream pair of the intermediate conveying rollers 41 and starts to be accelerated to a time point where the registration rollers 31 are activated for the back-side printing. In the second changing speed period, the switchback rollers 43 accelerate the sheet P having exited the most downstream pair of the intermediate conveying rollers 41, from the printing conveying speed Vg. The switchback rollers 43 accelerate the sheet P to a switchback speed Vs and cause the sheet P to maintain the switchback speed Vs for a predetermined time. Then, the switchback rollers 43 decelerate and stop the sheet P. The switchback speed Vs is a fixed value set in advance.

After the sheet P is stopped for a predetermined time, the switchback rollers 43 start switchback drive and accelerate the sheet P to the reverse conveying speed Vr. Thereafter, the switchback rollers 43, the horizontal conveying rollers 45, and the upward conveying rollers 47 convey the sheet P to the vertical conveying rollers 19 at the reverse conveying speed Vr. The vertical conveying rollers 19 receive the sheet P at the reverse conveying speed Vr. Then, the vertical conveying rollers 19 and the upward conveying rollers 47 decelerate the sheet P to the abutting conveying speed Vm before the sheet P reaches the registration rollers 31. The vertical conveying rollers 19 convey the sheet P by the abutting conveying distance Lm at the abutting conveying speed Vm and then stop the sheet P. The sheet P thereby abuts on the registration rollers 31 and is stopped with a slack of the slack amount Ltm formed therein. Thereafter, the second changing speed period ends at a timing of the activation of the registration rollers 31.

Durations (times) of the first changing speed period and the constant speed period are denoted by T1 and T2, respectively. Moreover, a time from the start of the second changing speed period to the start of the switchback drive by the switchback rollers 43 is denoted by T3. A time from the start of the switchback drive by the switchback rollers 43 to the end of the second changing speed period is denoted by T4.

As described above, the productivity for one side equivalent to that in the simplex printing can be achieved in the duplex printing when the time of one cycle is (2N−1) times the printing time Tps. Accordingly, the productivity for one side equivalent to that in the simplex printing can be achieved in the duplex printing, provided that the following formula (5) is satisfied.

$$T1+T2+T3+T4=Tps(2N-1) \quad (5)$$

In this formula, the accelerations of the registration rollers 31 in the cases where the rollers 31 are accelerated and decelerated are assumed to be fixed values. Accelerations of the switchback rollers 43 in the case where the rollers 43 are accelerated and decelerated are also assumed to be fixed values. Moreover, as described above, the top speed Vt of the registration rollers 31 and the switchback speed Vs of the switchback rollers 43 are also fixed values. Hence, the times T1 and T3 vary depending on the printing conveying speed Vg. Moreover, the time T2 varies depending on the printing conveying speed Vg and the sheet length Lp. The times T1 to T3 do not vary when the reverse conveying speed Vr varies.

Meanwhile, the time T4 varies depending on the reverse conveying speed Vr. The time T4 is expressed by the following formula (6) by using the formula (5). The reverse conveying speed Vr is calculated to be such a value that the time T4 satisfies the formula (6).

$$T4=Tps(2N-1)-(T1+T2+T3) \quad (6)$$

A time from the start of the time T4 to a time point where the sheet P reaches reverse conveying speed Vr is denoted by T41, a time in which the sheet P is conveyed at a constant speed of the reverse conveying speed Vr is denoted by T42, and a time from the start of deceleration from the reverse conveying speed Vr to the end of the time T4 is denoted by T43. In other words, the following formula (7) is established.

$$T4=T41+T42+T43 \quad (7)$$

In this formula, the acceleration of the switchback rollers 43 in the case where the rollers 43 are accelerated is set to the fixed value of au which is the same as the acceleration of the vertical conveying rollers 19 in the case where rollers 19 are accelerated. The time T41 is expressed by the following formula (8).

$$T41=Vr/\alpha u \quad (8)$$

The time T42 is expressed by the following formula (9), where L42 is the conveying distance at the reverse conveying speed Vr.

$$T42=L42/Vr \quad (9)$$

The time T43 is expressed by the following formula (10).

$$T43=Vr/|\alpha d|+Lm/Vm+Tsc \quad (10)$$

Vr/|αd| in the formula (10) is the total of the time from the start of deceleration from the reverse conveying speed Vr to the time point where the sheet conveying speed reaches the abutting conveying speed Vm and the time from the start of deceleration from the abutting conveying speed Vm to the stop. Lm/Vm is a conveying time at the abutting conveying speed Vm. Tsc is a paper refeeding timing adjustment time. The paper refeeding timing adjustment time Tsc is a theoretical value of a time from the stopping of the sheet P printed on the front side after abutting on the registration rollers 31 to the timing of activation of the registration rollers 31.

The conveying distance L42 at the reverse conveying speed Vr is expressed by the following formula (11).

$$L42=Lsr+Ltm-Ls-L41-L43 \quad (11)$$

In this formula, Lsr is a distance from the pair of switchback rollers 43 to the pair of registration rollers 31 in the conveying route. Ls is a switchback trailing-edge left amount. The switchback trailing-edge left amount Ls is a distance from the pair of switchback rollers 43 to the trailing edge of the sheet P in the conveying direction in normal rotation at the time when the switchback rollers 43 are stopped in order to be reversely rotated for the switchback. L41 and L43 are conveying distances in periods corresponding to the times T41 and T43, respectively.

The conveying distances L41 and L43 are expressed by the following formulae (12) and (13), respectively.

$$L41=Vr^2/2\alpha u \quad (12)$$

$$L43=Vr^2/2|\alpha d|+Lm \quad (13)$$

$Vr^2/2|\alpha d|$ in the formula (13) is the total of a conveying distance in a period from the start of deceleration from the reverse conveying speed Vr to the time point where the sheet conveying speed reaches the abutting conveying speed Vm and a conveying distance in a period from the start of deceleration from the abutting conveying speed Vm to the stop.

The following formula (14) is obtained from the formulae (9) and (11) to (13).

$$T42=(Lsr+Ltm-Ls-Lm)/Vr-(\tfrac{1}{2}\alpha u+\tfrac{1}{2}|\alpha d|)Vr \quad (14)$$

Then, the following formula (15) is obtained from the formulae (6) to (8), (10), and (14).

$$(\tfrac{1}{2}\alpha u+\tfrac{1}{2}|\alpha d|)Vr^2+(Lm/Vm+Tsc-Tps(2N-1)+(T1+T2+T3))Vr+(Lsr+Ltm-Ls-Lm)=0 \quad (15)$$

The reverse conveying speed Vr is calculated by solving the formula (15) for Vr. Note that, among the solutions of the formula (15), a solution satisfying Vr>Vg is employed as the reverse conveying speed Vr.

Next, description is given of an operation of the vertical conveying rollers 19 in the period when the front-side printing and the back-side printing are performed alternately in the duplex printing in which the sheets P are fed from the internal paper feed trays 13A and 13B.

When the duplex printing is performed with the sheets P fed from the internal paper feed trays 13A and 13B, the unprinted sheets P and the sheets P printed on the front sides alternately reach the vertical conveying rollers 19 in the period when the front-side printing and the back-side printing are alternately performed. In this case, the unprinted sheets P are conveyed from the internal paper feeding conveying rollers 16C at the paper feeding conveying speed Vk while the sheets P printed on the front sides are conveyed from the circulation conveyer 4 at the reverse conveying speed Vr. Accordingly, the operation of the vertical conveying rollers 19 is switched between the paper feeding conveying operation which is an operation performed in the feeding of the unprinted sheets P and the paper refeeding conveying operation which is an operation performed in the refeeding of the sheets P printed on the front sides.

Since the printing time Tps is the same in the front-side printing and the back-side printing, the vertical conveying rollers 19 are controlled such that an operation time of the paper feeding conveying operation and an operation time of the paper refeeding conveying operation are equal in the period in which the front-side printing and the back-side printing are alternately performed. In this case, the paper feeding conveying operation includes a paper feeding operation in which the vertical conveying rollers 19 receive the unprinted sheet P and cause the sheet P to abut on the registration rollers 31 and an assisting operation in which the vertical conveying rollers 19, together with the registration rollers 31, convey the sheet P. Moreover, the paper refeeding conveying operation includes a paper refeeding operation in which the vertical conveying rollers 19 receive the sheet P printed on the front side and cause the sheet. P to abut on the registration rollers 31 and the assisting operation.

Figure 7:
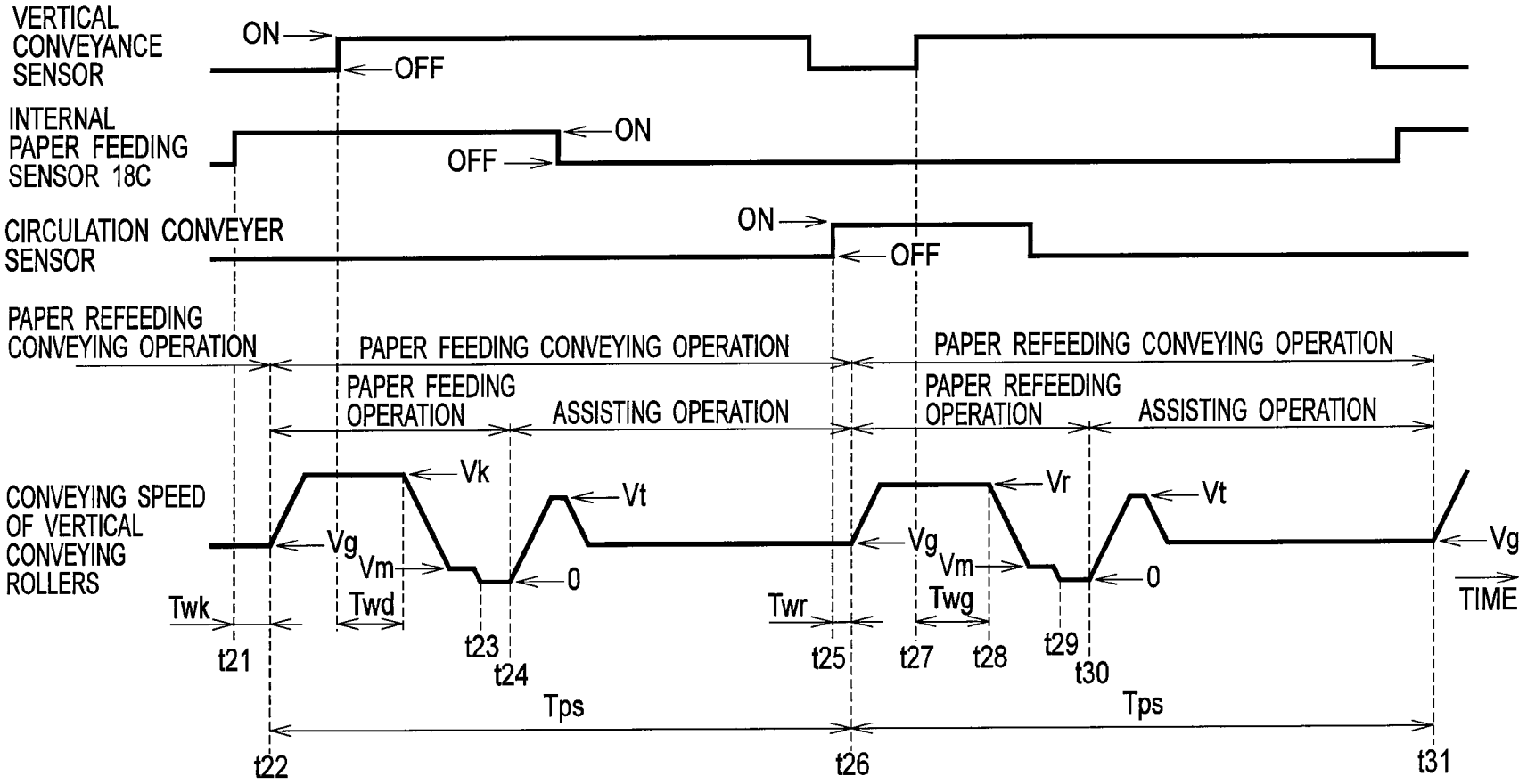
FIG. 7 is a timing chart for explaining an operation of vertical conveying rollers in a period when front-side printing and back-side printing are alternately performed in the duplex printing in which the sheets are fed from the internal paper feed trays.

FIG. 7 is a timing chart for explaining the operation of the vertical conveying rollers 19 in the period when the front-side printing and the back-side printing are alternately performed in the duplex printing in which the sheets P are fed from the internal paper feed trays 13A and 13B.

The leading edge of the unprinted sheet P picked up from the internal paper feed tray 13A or 13B is detected by the internal paper feeding sensor 18C at a time point t21 of FIG. 7. At a time point t22, that is, upon elapse of the aforementioned paper feeding acceleration waiting time Twk from the time point t21, the controller 6 starts the acceleration of the vertical conveying rollers 19. The paper feeding conveying operation starts from this time point. The vertical conveying rollers 19 are driven at the printing conveying speed Vg until the time point t22 to perform the assisting operation in the paper refeeding conveying operation performed just before the paper feeding conveying operation.

In this case, the unprinted sheet P is picked up from the internal paper feed tray 13A or 13B at a timing corresponding to the activation timing of the registration rollers 31 corresponding to the printing schedule and is conveyed. In the period when the front-side printing and the back-side printing are alternately performed, the registration rollers 31 are activated every printing time Tps as in the simplex printing described above.

The operation of the vertical conveying rollers 19 in the period from the time point t22 to the time point t23 is similar to the operation of the vertical conveying rollers 19 in the period from the time point t14 to the time point t17 in FIG. 3 described above.

Starting the acceleration of the vertical conveying rollers 19 at the time point t22, that is, upon elapse of the paper feeding acceleration waiting time Twk from the time point t21 can cause the vertical conveying rollers 19 to reach the paper feeding conveying speed Vk at a time point where the leading edge of the sheet P is behind (upstream of) the vertical conveying rollers 19 by the margin Lkm. The vertical conveying rollers 19 are thus prepared to receive the sheet P conveyed at the paper feeding conveying speed Vk at a time point where the sheet P reaches the vertical conveying rollers 19.

When the sheet P reaches the vertical conveying rollers 19, the vertical conveying rollers 19 receive the sheet P at the paper feeding conveying speed Vk and convey the sheet P. Then, the vertical conveying rollers 19 cause the sheet P to abut on the registration rollers 31 at the abutting conveying speed Vm to form a slack and are stopped at a time point t23.

Thereafter, at a time point t24 which is the activation timing of the registration rollers 31, the controller 6 activates the vertical conveying rollers 19 for the assisting operation. Then, the controller 6 causes the vertical conveying rollers 19 to operate in synchronization with the registration rollers 31.

Next, the leading edge of the sheet P printed on the front side is detected by the circulation conveyer sensor 49 at a time point t25. At a time point t26, that is, upon elapse of a paper refeeding acceleration waiting time Twr from the time point t25, the controller 6 starts the acceleration of the vertical conveying rollers 19 from the printing conveying speed Vg. The paper feeding conveying operation is completed at this time point and the paper refeeding conveying operation is started. When the conveying speed of the vertical conveying rollers 19 reaches the reverse conveying speed Vr, the controller 6 causes the vertical conveying rollers 19 to maintain the reverse conveying speed Vr.

The paper refeeding acceleration waiting time Twr is expressed by the following formula (16).

$$Twr=(Lr-(Vr^2-Vg^2)/2\alpha u-Lkm)/Vr \quad (16)$$

In this formula, Lr is a distance between the circulation conveyer sensor 49 and the pair of vertical conveying rollers 19 in the conveying route.

$(Vr^2-Vg^2)/2\alpha u$ in the formula (16) is a conveying distance (acceleration distance) of the sheet P by the vertical conveying rollers 19 in a period when the vertical conveying rollers 19 are accelerated from the printing conveying speed Vg to the reverse conveying speed Vr at the acceleration $\alpha u$.

The paper refeeding acceleration waiting time Twr expressed by the formula (16) is a time required to convey the sheet P at the reverse conveying speed Vr over a distance obtained by subtracting the acceleration distance $(Vr^2-Vg^2)/2\alpha u$ and the margin Lkm from the distance Lr between the circulation conveyer sensor 49 and the pair of vertical conveying rollers 19. Accordingly, starting the acceleration of the vertical conveying rollers 19 at the time point t26, that is, upon elapse of the paper refeeding acceleration waiting time Twr from the time point t25 can cause the speed of the vertical conveying rollers 19 to reach the reverse conveying speed Vr at the time point where the leading edge of the sheet P is behind (upstream of) the vertical conveying rollers 19 by the margin Lkm. The vertical conveying rollers 19 are thus prepared to receive the sheet P conveyed at the reverse conveying speed Vr at a time point where the second sheet P reaches the vertical conveying rollers 19.

When the sheet P reaches the vertical conveying rollers 19, the vertical conveying rollers 19 receive the sheet P at the reverse conveying speed Vr and convey the sheet P. The leading edge of the sheet P is detected by the vertical conveying sensor 21 at a time point t27. At a time point t28, that is, upon elapse of a paper refeeding deceleration waiting time Twg from the time point t27, the deceleration of the vertical conveying rollers 19 is started.

The paper refeeding deceleration waiting time Twg is expressed by the following formula (17).

$$Twg=(Lv-Vr^2/2|\alpha d|-Lm+Ltm)/Vr \quad (17)$$

When the sheet conveying speed is reduced to the abutting conveying speed Vm after the start of deceleration of the vertical conveying rollers 19 at the time point t28, the controller 6 causes the vertical conveying rollers 19 to maintain the abutting conveying speed Vm until the sheet P is conveyed by the abutting conveying distance Lm, and then stops the vertical conveying rollers 19 at a time point t29.

The paper refeeding deceleration waiting time Twg expressed by the formula (17) is equivalent to the paper feeding deceleration waiting time Twd expressed by the aforementioned formula (3) in which the paper feeding conveying speed Vk is replaced by the reverse conveying speed Vr. Specifically, the paper refeeding deceleration waiting time Twg is a time required to convey the sheet P at the reverse conveying speed Vr over a distance obtained by subtracting "$Vr^2/2|\alpha d|+Lm$", which is the conveying distance in a period from the time point t28 to the time point t29, from a distance obtained by adding the slack amount Ltm to the distance Lv between the vertical conveying sensor 21 and the pair of registration rollers 31. Accordingly, starting the deceleration of the vertical conveying rollers 19 at the time point t28, that is, upon elapse of the paper refeeding deceleration waiting time Twg from the time point t27 can cause the vertical conveying rollers 19 to stop in a state where the sheet P abuts on the registration rollers 31 with a slack of the slack amount Ltm formed in the sheet P.

Thereafter, at a time point t30 which is the activation timing of the registration rollers 31, the controller 6 activates the vertical conveying rollers 19 for the assisting operation. Then, the controller 6 causes the vertical conveying rollers 19 to operate in synchronization with the registration rollers 31.

At a time point t31 which is an acceleration start timing of the vertical conveying rollers 19 in the next paper feeding conveying operation, the paper refeeding conveying operation is completed and shifts to the paper feeding conveying operation. The paper feeding conveying operation and the paper refeeding conveying operation are alternately repeated as described above.

Next, description is given of an operation of the printer 1 in the duplex printing in which the sheets P are fed from the internal paper feed trays 13A and 13B.

Figure 8:
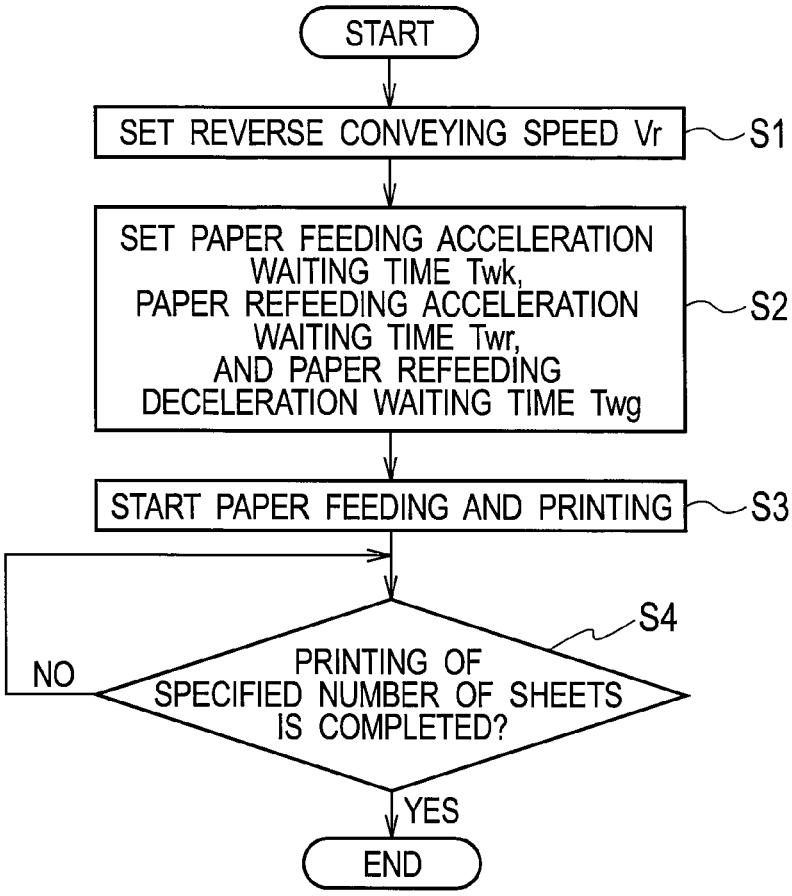
FIG. 8 is a flowchart for explaining an operation of the printer in the duplex printing in which the sheets are fed from the internal paper feed trays.

FIG. 8 is a flowchart for explaining the operation of the printer 1 in the duplex printing in which the sheets P are fed from the internal paper feed trays 13A and 13B. The processing in the flowchart of FIG. 8 starts upon input of a print job into the printer 1.

In step S1 of FIG. 8, the controller 6 calculates the reverse conveying speed Vr based on printing conditions. Specifically, the controller 6 obtains information indicating the printing conditions such as the sheet size, the sheet type, and the printing resolution from print setting information included in the print job. Then, the controller 6 obtains the sheet length Lp from the sheet size and sets the one-side consecutive number N corresponding to the sheet length Lp. Moreover, the controller 6 sets the printing conveying speed Vg based on the sheet type, the printing resolution, and the like. The controller 6 calculates the reverse conveying speed Vr from the formula (15) by using various values including the set values described above. Then, the controller 6 sets the calculated reverse conveying speed Vr as a value used in execution of printing.

Next, in step S2, the controller 6 calculates the paper feeding acceleration waiting time Twk corresponding to the set printing conveying speed Vg. Moreover, the controller 6 calculates the paper refeeding acceleration waiting time Twr and the paper refeeding deceleration waiting time Twg corresponding to the printing conveying speed Vg and the reverse conveying speed Vr. Then, the controller 6 sets the calculated paper feeding acceleration waiting time Twk, paper refeeding acceleration waiting time Twr, and paper refeeding deceleration waiting time Twg as the values used in execution of printing. Note that, since the activation waiting time Tws and the paper feeding deceleration waiting time Twd do not vary depending on the printing conditions, these times are calculated and set in advance.

Next, in step S3, the controller 6 starts the paper feeding and the printing. First, in the feeding of the first sheet, the controller 6 causes the internal paper feeding rollers 14A or 14B, the internal paper feeding conveying rollers 16A to 16C, and the vertical conveying rollers 19 to operate as in the period from the time point t1 to the time point t9 in FIG. 3 described above. Each of the sheets P is thereby picked up and conveyed from the internal paper feed tray 13A or 13B and abuts on the registration rollers 31 to stop.

After the first sheet P abuts on the registration rollers 31 and stops, the controller 6 activates the registration rollers 31 and also activates the internal paper feeding conveying rollers 16A to 16C and the vertical conveying rollers 19 for the assisting operation. The sheet P is sent to the belt conveyer 33 by the drive of the registration rollers 31 and the assisting operation of the internal paper feeding conveying rollers 16A to 16C and the vertical conveying rollers 19.

When the trailing edge of the first sheet P is detected by the internal paper feeding sensor 18C, the controller 6 stops the internal paper feeding conveying rollers 16A to 16C to terminate the assisting operation. Moreover, when the trailing edge of the first sheet P is detected by the vertical conveying sensor 21, the controller 6 stops the vertical conveying rollers 19 to terminate the assisting operation.

The operations of the internal paper feeding rollers 14A or 14B and the internal paper feeding conveying rollers 16A to 16C in the feeding of the second and subsequent sheets are the same as the aforementioned operations for the feeding of the first sheet. In the duplex printing, the activation of the internal paper feeding rollers 14A or 14B is performed at intervals of 2 Tps corresponding to the printing schedule like one in FIG. 5, and the unprinted sheets P are sequentially fed.

The unprinted sheet P fed from the internal paper feed tray 13A or 13B and sent out from the registration rollers 31 is subjected to printing on the front side by using the inks ejected from the head unit 35 while being conveyed by the belt conveyer 33 at the set printing conveying speed Vg. The sheet P printed on the front side is guided to the circulation route RC by the first switching part 51 and is conveyed to the switchback rollers 43 by the intermediate conveying rollers 41.

Then, the sheet P is tuned over by being switched back by the switchback rollers 43. The switched back sheet P is conveyed to the vertical conveying rollers 19 at the set reverse conveying speed Vr by the horizontal conveying rollers 45 and the upward conveying rollers 47.

An operation of the vertical conveying rollers 19 in this case is the same as the operation in the feeding of the first sheet described above for the first N−1 sheets. In the case of feeding of the N-th sheet, the sheet P printed on the front side is conveyed from the circulation conveyer 4 between the feeding of the N-th sheet and the feeding of the (N+1)th sheet. Accordingly, the vertical conveying rollers 19 are not stopped when the trailing end of the first sheet P is detected by the vertical conveying sensor 21, and shift to the aforementioned paper refeeding conveying operation while maintaining the printing conveying speed Vg in the assisting operation. Thereafter, the vertical conveying rollers 19 alternately perform the paper feeding conveying operation and the paper refeeding conveying operation as shown in FIG. 7. The controller 6 uses the values calculated and set in step S2 as the paper feeding acceleration waiting time Twk and the paper refeeding acceleration waiting time Twr which are used to determine the timings of switching from the paper feeding conveying operation to the paper refeeding conveying operation and vice versa.

When the sheet P printed on the front side is conveyed to the vertical conveying rollers 19 at the reverse conveying speed Vr, the sheet P is refed to the registration rollers 31 by the vertical conveying rollers 19 and stopped with a slack of the slack amount Ltm formed therein. Conveying the sheet P printed on the front side to the vertical conveying rollers 19 at the reverse conveying speed Vr after the switchback causes the sheet P to be refed to the registration rollers 31 at a timing corresponding to the printing schedule.

Thereafter, the sheet P printed on the front side is sent to the belt conveyer 33 by the drive of the registration rollers 31 and the assisting operation of the vertical conveying rollers 19. Then, the sheet P is subjected to the back-side printing by using the inks ejected from the head unit 35 while being conveyed by the belt conveyer 33 at the printing conveying speed Vg. Next, the sheet P printed on the both sides is discharged by the paper discharger 5.

After step S3, in step S4, the controller 6 determines whether printing of the specified number of sheets which is set in the print job is completed. When the controller 6 determines that the printing of the specified number of sheets is not completed (step S4: NO), the controller 6 repeats step S4. When the controller 6 determines that the printing of the specified number of sheets is completed (step S4: YES), the controller terminates the series of operations.

As described above, in the printer 1, the vertical conveying rollers 19 double as conveying rollers for paper feeding and conveying rollers for paper refeeding. This reduces the number of conveying rollers and achieves size reduction of the apparatus.

Moreover, in the printer 1, the controller 6 sets the reverse conveying speed Vr corresponding to the printing schedule of the printing unit 3, based on the printing conditions, in the duplex printing. When the sheets P are fed from the internal paper feed tray 13A or 13B in the duplex printing, the controller 6 performs control of switching the operation of the vertical conveying rollers 19 between: the paper feeding conveying operation in which the vertical conveying rollers 19 receive the unprinted sheets at the paper feeding conveying speed Vk and convey the sheets to the printing unit 3; and the paper refeeding conveying operation in which the vertical conveying rollers 19 receive the sheets P printed on the front sides at the reverse conveying speed Vr and convey the sheets P to the printing unit 3. The controller 6 controls the timings of the switching depending on the printing schedule.

Specifically, the controller 6 switches the operation of the vertical conveying rollers 19 from the paper refeeding conveying operation to the paper feeding conveying operation, based on the timing at which the unprinted sheet P picked up from the internal paper feed tray 13A or 13B at a timing corresponding to the printing schedule and conveyed at the paper feeding conveying speed Vk is detected by the internal paper feeding sensor 18C. Moreover, the controller 6 switches the operation of the vertical conveying rollers 19 from the paper conveying feeding operation to the paper refeeding conveying operation, based on the timing at which the sheet P printed on the front side and conveyed at the reverse conveying speed Vr in the circulation conveyer 4 is detected by the circulation conveyer sensor 49.

The paper feeding and the paper refeeding can be thereby performed at timings corresponding to the printing schedule of the printing unit 3 without interposing a waiting time for completion of the operation of the vertical conveying rollers 19. As a result, reduction in the productivity of printed matters of the printing unit 3 can be suppressed.

Therefore, the printer 1 can suppress reduction in the productivity of printed matters while achieving size reduction of the apparatus.

Moreover, the controller 6 switches the operation of the vertical conveying rollers 19 from the paper feeding conveying operation to the paper refeeding conveying operation upon elapse of the paper refeeding acceleration waiting time Twr from the timing at which the sheet P reaches the circulation conveyer sensor 49 arranged at a predetermined position in the circulation route RC upstream of the vertical conveying rollers 19. As can be seen from the formula (16), the paper refeeding acceleration waiting time Twr is a time required to convey the sheet P at the reverse conveying speed Vr for "$Lr-(Vr^2-Vg^2)/2\alpha u-Lkm$" which is the set distance corresponding to the reverse conveying speed Vr.

Moreover, the controller 6 switches the operation of the vertical conveying rollers 19 from the paper refeeding conveying operation to the paper feeding conveying operation upon elapse of the paper feeding acceleration waiting time Twk from the timing at which the sheet P reaches the internal paper feeding sensor 18C arranged at a predetermined position in the internal paper feeding route RS2 upstream of the vertical conveying rollers 19. As can be seen from the formula (4), the paper feeding acceleration waiting time Twk is a time required to convey the sheet P at the paper feeding conveying speed Vk for "$Lk-(Vk^2-Vg^2)/2\alpha u-Lkm$" which is the set distance corresponding to the paper feeding conveying speed Vk.

The printer 1 can thus switch the operation of the vertical conveying rollers 19 at timings corresponding to the reverse conveying speed Vr and the paper feeding conveying speed Vk without performing complex control.

Moreover, the controller 6 controls the vertical conveying rollers 19 such that the operation time of the paper feeding conveying operation and the operation time of the paper refeeding conveying operation are equal in the period in which the front-side printing and the back-side printing are alternately performed. The duplex printing can be thereby performed in the interleaving method with the productivity for one side being equivalent to that in the simplex printing.

Modified Example

Next, description is given of a modified example in which control of paper feeding from the internal paper feed trays 13A and 13B is partially changed from that in the aforementioned embodiment.

In the aforementioned embodiment, in the feeding of each of the sheets P from the internal paper feed trays 13A and 13B, the detection timing of the leading edge of the sheet by the internal paper feeding sensor 18C is used to determine the timing of activation or acceleration start of the vertical conveying rollers 19. Moreover, in the aforementioned embodiment, the detection timing of the leading edge of the sheet by the internal paper feeding sensor 18C is used as a trigger for terminating the correction of the conveying speed of the internal paper feeding conveying rollers 16A to 16C which is performed when the sheet P is delayed or advanced.

Meanwhile, in the modified example, in the feeding of each of the sheets P from the internal paper feed trays 13A and 13B, the timing of activation or acceleration start of the vertical conveying rollers 19 is determined without using the detection output of the internal paper feeding sensor 18C. Moreover, in the modified example, the timing of terminating the correction of the conveying speed of the internal paper feeding conveying rollers 16A to 16C is determined without using the detection output of the internal paper feeding sensor 18C.

First, description is given of the timing of activation or acceleration start of the vertical conveying rollers 19 in the feeding of each of the sheets P from the internal paper feed trays 13A and 13B in the modified example.

In the embodiment, in the activation or the acceleration start of the vertical conveying rollers 19 in the feeding of each of the sheets from the internal paper feed trays 13A and 13B, the detection timing of the leading edge of the sheet by the internal paper feeding sensor 18C in the aforementioned embodiment is replaced by a timing at which a set reaching time elapses from the activation timing of the internal paper feeding rollers 14A or 14B.

The set reaching time is a theoretical value of a time which the leading edge of the sheet takes to reach the position of the internal paper feeding sensor 18C from the activation of the internal paper feeding rollers 14A or 14B. In this case, values of the set reaching times corresponding respectively to the internal paper feed trays 13A and 13B are provided. The set reaching time corresponding to the internal paper feed tray 13A is denoted by Tra, and the set reaching time corresponding to the internal paper feed tray 13B is denoted by Trb. The set reaching times Tra and Trb are expressed by the following formulae (18) and (19), respectively.

$$Tra=Vk/\alpha k+(Lpa/\beta-Vk^2/2\alpha k+Lna)/Vk \quad (18)$$

$$Trb=Vk/\alpha k+(Lpb/\beta-Vk^2/2\alpha k+Lnb)/Vk \quad (19)$$

In these formulae, $\alpha k$ is the acceleration of the internal paper feeding rollers 14A and 14B in the case where the rollers 14A and 14B are accelerating. Lpa is a distance between the pair of internal paper feeding rollers 14A and the pair of internal paper feeding conveying rollers 16A in the conveying route. Lna is a distance between the pair of internal paper feeding conveying rollers 16A and the internal paper feeding sensor 18C in the conveying route. Lpb is a distance between the pair of internal paper feeding rollers 14B and the pair of internal paper feeding conveying rollers 16B in the conveying route. Lnb is a distance between the pair of internal paper feeding conveying rollers 16B and the internal paper feeding sensor 18C in the conveying route. β is a conveying ratio of each of the pairs of the internal paper feeding rollers 14A and 14B. The conveying ratio β is a ratio of an actual conveying amount to a theoretical value of a conveying amount of each of the pairs of the internal paper feeding rollers 14A and 14B. The conveying ratio β is obtained through experiments.

For example, in the case of activating the vertical conveying rollers 19 in the feeding of the first sheet from the internal paper feed tray 13A, the controller 6 activates the vertical conveying rollers 19 upon elapse of the activation waiting time Tws from a timing at which the set reaching time Tra elapses from the activation of the internal paper feeding rollers 14A.

Moreover, for example, in a case where the operation of the vertical conveying rollers 19 is switched from the paper refeeding conveying operation to the paper feeding conveying operation in the paper feeding from the internal paper feed tray 13B, the controller 6 starts the acceleration of the vertical conveying rollers 19 upon elapse of the paper feeding acceleration waiting time Twk from a timing at which the set reaching time Trb elapses from the activation of the internal paper feeding rollers 14B.

Next, description is given of correction of the conveying speed of the internal paper feeding conveying rollers 16A to 16C in the modified example.

Figure 9:
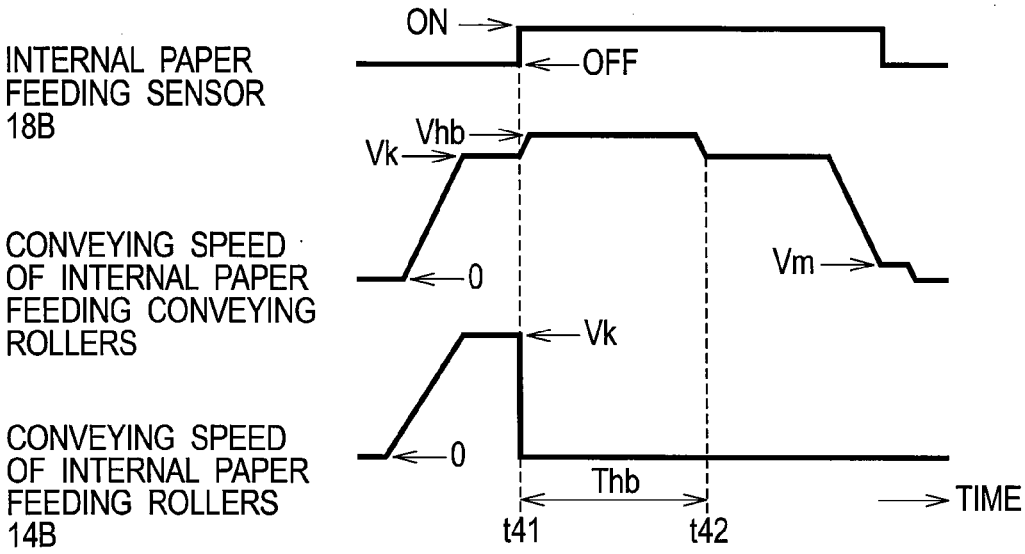
FIG. 9 is a timing chart for explaining correction of a conveying speed of internal paper feeding conveying rollers in a modified example.

FIG. 9 is a timing chart for explaining the correction of the conveying speed of the internal paper feeding conveying rollers 16A to 16C. FIG. 9 shows a timing chart in the paper feeding from the internal paper feed tray 13B.

In the paper feeding from the internal paper feed tray 13B, when the leading edge of the sheet P picked up from the internal paper feed tray 13B by the internal paper feeding rollers 14B reaches the internal paper feeding sensor 18B, the controller 6 determines whether the reaching timing of the leading edge of the sheet P is delayed or advanced relative to the theoretical value of the reaching timing. When there is no delay or advance, the controller 6 does not correct the conveying speed of the internal paper feeding conveying rollers 16A to 16C.

When there is delay or advance of the sheet P, as shown in FIG. 9, the controller 6 changes the conveying speed of the internal paper feeding conveying rollers 16A to 16C from the paper feeding conveying speed Vk to a correction speed Vhb at a time point t41 at which the leading edge of the sheet P reaches internal paper feeding sensor 18B. In this case, the controller 6 calculates the correction speed Vhb, based on a delay time Td of the reaching timing to the internal paper feeding sensor 18B relative to the theoretical value of the reaching timing. A method of calculating the correction speed Vhb is described later.

Thereafter, the controller 6 controls the conveying speed of the internal paper feeding conveying rollers 16A to 16C such that the conveying speed is restored from the correction speed Vhb to the paper feeding conveying speed Vk at a time point t42, that is, upon elapse of a correction time Thb from the time point t41. The correction of the conveying speed of the internal paper feeding conveying rollers 16A to 16C is thereby terminated.

The correction time Thb is a time required for the leading edge of the sheet P to reach a correction terminating position from a time point where the leading edge reaches the internal paper feeding sensor 18B. The correction terminating position is a position set in the conveying route, upstream and near the vertical conveying rollers 19.

The correction time Thb is calculated from the following formula (20).

$$Thb=Tcb-Td \tag{20}$$

In this formula, Tcb is a standard conveying time in the paper feeding from the internal paper feed tray 13B. The standard conveying time Tcb is calculated from the following formula (21).

$$Tcb=Lhb/Vk \tag{21}$$

In this formula, Lhb is a distance between the internal paper feeding sensor 18B and the correction terminating position in the conveying route. In other words, the standard conveying time Tcb is a time required to convey the sheet P from the internal paper feeding sensor 18B to the correction terminating position at the paper feeding conveying speed Vk without performing the correction of the conveying speed.

The delay time Td is set to a positive value when the reaching timing of the sheet P to the internal paper feeding sensor 18B is delayed relative to the theoretical value thereof, and is set to a negative value when the reaching timing is advanced from the theoretical value thereof.

Next, the method of calculating the correction speed Vhb is described.

The correction speed Vhb is determined such that the conveying distance of the sheet P in the correction time Thb is set to be equal to the distance Lhb between the internal paper feeding sensor 18B and the correction terminating position.

Figure 10:
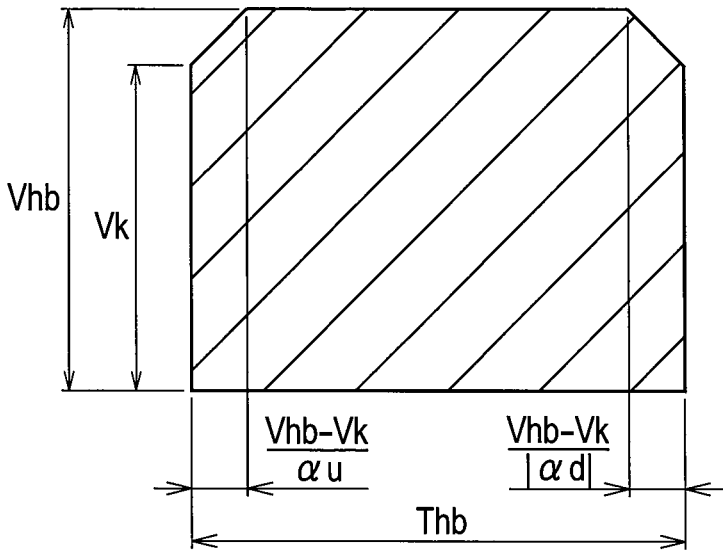
FIG. 10 is a view for explaining a method of determining a correction speed when the sheet is delayed in the modified example.

When the sheet P is delayed (in the case of Td>0), the correction speed Vhb is set to a speed faster than the paper feeding conveying speed Vk to make up for the delay. In this case, the conveying distance of the sheet P in the correction time Thb corresponds to the area of a region shaded by diagonal lines in FIG. 10. Here, the acceleration of the internal paper feeding conveying rollers 16A to 16C in the case where the rollers 16A to 16C are accelerated is set to au which is the same as the acceleration of the vertical conveying rollers 19 in the case where the rollers 19 are accelerated. Moreover, the acceleration of the internal paper feeding conveying rollers 16A to 16C in the case where the rollers 16A to 16C are decelerated is set to αd which is the same as the acceleration of the vertical conveying rollers 19 in the case where the rollers 19 are decelerated.

Hence, the following formula (22) is established.

$$(Vhb^2-Vk^2)/2\alpha u+(Thb-(Vhb-Vk)/\alpha u-(Vhb-Vk)/|\alpha d|)\,Vhb+(Vhb^2-Vk^2)/2|\alpha d|=Lhb \tag{22}$$

The following formula (23) is obtained from the formulae (20) and (22).

$$(\tfrac{1}{2}\alpha u+\tfrac{1}{2}|\alpha d|)Vhb^2-((Tcb-Td)+(1/\alpha u+1/|\alpha d|)Vk)\,Vhb+(\tfrac{1}{2}\alpha u+\tfrac{1}{2}|\alpha d|)Vk^2+Lhb=0 \tag{23}$$

The correction speed Vhb in the case where the sheet P is delayed can be obtained by solving the formula (23) for Vhb. Note that, among the solutions of the formula (23), a solution of a positive number is used as the correction speed Vhb.

Figure 11:
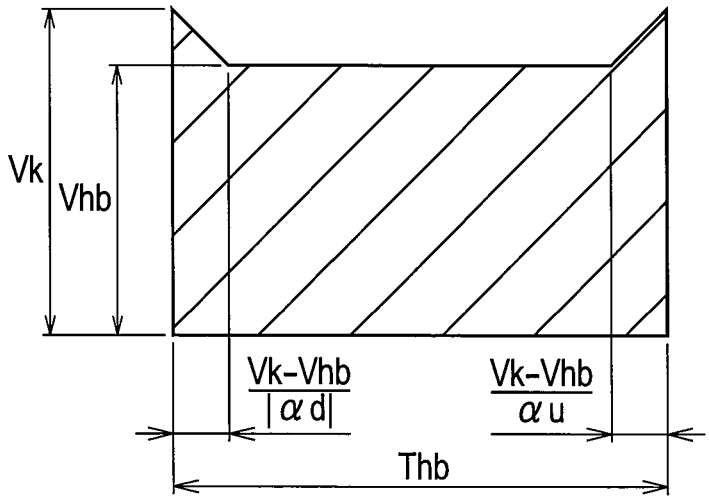
FIG. 11 is a view for explaining a method of determining the correction speed when the sheet is advanced in the modified example.

Meanwhile, when the sheet P is advanced (in the case of Td<0), the correction speed Vhb is set to a speed slower than the paper feeding conveying speed Vk to perform adjustment for the advance. In this case, the conveying distance of the sheet P in the correction time Thb corresponds to the area of a region shadowed by diagonal lines in FIG. 11.

Hence, the following formula (24) is established.

$$(Vk^2-Vhb^2)/2\alpha u+(Thb-(Vk-Vhb)/\alpha u-(Vk-Vhb)/|\alpha d|)Vhb+(Vk^2-Vhb^2)/2|\alpha d|=Lhb \quad (24)$$

The following formula (25) is obtained from the formulae (20) and (24).

$$(\tfrac{1}{2}\alpha u+\tfrac{1}{2}|\alpha d|)Vhb^2+((Tcb-Td)-(1/\alpha u+1/|\alpha d|)Vk)Vhb+(\tfrac{1}{2}\alpha u+\tfrac{1}{2}|\alpha d|)Vk^2-Lhb=0 \quad (25)$$

The correction speed Vhb in the case where the sheet P is advanced can be obtained by solving the formula (25) for Vhb. Note that, among the solutions of the formula (25), a solution of a positive number is used as the correction speed Vhb.

When the leading edge of the sheet P reaches the internal paper feeding sensor 18A in the paper feeding from the internal paper feed tray 13A, the controller 6 determines whether the reaching timing of the leading edge is delayed or advanced relative to the theoretical value of the reaching timing. When the sheet P is delayed or advanced, the controller 6 changes the conveying speed of the internal paper feeding conveying rollers 16A to 16C from the paper feeding conveying speed Vk to a correction speed Vha.

Thereafter, the controller 6 controls the conveying speed of the internal paper feeding conveying rollers 16A to 16C such that the conveying speed is restored from the correction speed Vha to the paper feeding conveying speed Vk upon elapse of a correction time Tha from the reaching timing of the sheet P to the internal paper feeding sensor 18A. The correction of the conveying speed of the internal paper feeding conveying rollers 16A to 16C is thereby terminated.

The correction time Tha in the paper feeding from the internal paper feed tray 13A is calculated from the following formula (26).

$$Tha=Tca-Td \quad (26)$$

In this formula, Tca is a standard conveying time in the paper feeding from the internal paper feed tray 13A. The standard conveying time Tca is calculated from the following formula (27).

$$Tca=Lha/Vk \quad (27)$$

In this formula, Lha is a distance between the internal paper feeding sensor 18A and the correction terminating position in the conveying route. In other words, the standard conveying time Tca is a time required to convey the sheet P from the internal paper feeding sensor 18A to the correction terminating position at the paper feeding conveying speed Vk without performing the correction of the conveying speed.

The correction speed Vha in the case where the sheet P is delayed (in the case of Td>0) is obtained by solving the following formula (28) for Vha.

$$(\tfrac{1}{2}\alpha u+\tfrac{1}{2}|\alpha d|)Vha^2-((Tca-Td)+(1/\alpha u+1/|\alpha d|)Vk)Vha+(\tfrac{1}{2}\alpha u+\tfrac{1}{2}|\alpha d|)Vk^2-Lha=0 \quad (28)$$

Meanwhile, the correction speed Vha in the case where the sheet P is advanced (in the case of Td<0) is obtained by solving the following formula (29) for Vha.

$$(\tfrac{1}{2}\alpha u+\tfrac{1}{2}|\alpha d|)Vha^2+((Tca-Td)-(1/\alpha u+1/|\alpha d)Vk)Vha+(\tfrac{1}{2}\alpha u+\tfrac{1}{2}|\alpha d|)Vk^2-Lha=0 \quad (29)$$

The formulae (28) and (29) are derived by a method similar to that for the aforementioned formulae (23) and (25).

When the controller 6 corrects the paper feeding conveying speed Vk, the controller 6 also corrects the aforementioned set reaching times Tra and Trb depending on the correction speeds Vha and Vhb.

As described above, in the modified example, the controller 6 determines the timing of activation or acceleration start of the vertical conveying rollers 19 in the feeding of each sheet P from the internal paper feed trays 13A and 13B without using the detection output of the internal paper feeding sensor 18C. Moreover, the controller 6 determines the timing of terminating the correction of the conveying speed of the internal paper feeding conveying rollers 16A to 16C without using the detection output of the internal paper feeding sensor 18C.

The timing of the activation or acceleration start of the vertical conveying rollers 19 in the feeding of each sheet P from the internal paper feeding trays 13A and 13B and the timing of terminating the correction of the conveying speed of the internal paper feeding conveying rollers 16A and 16C can be thereby determined in a configuration in which the internal paper feeding sensor 18C is omitted due to a limited space or the like.

Moreover, a trailing edge portion of the sheet P abutting on the registration rollers 31 is left in a section upstream of the internal paper feeding sensor 18C. This can prevent an erroneous operation of the vertical conveying rollers 19 when chattering of the internal paper feeding sensor 18C occurs.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printer comprising:

a printing unit configured to perform printing on a sheet while conveying the sheet based on a printing schedule;

a circulation conveyer including a circulation route and configured in duplex printing to receive the sheet with a front side printed from the printing unit and convey the received sheet along the circulation route;

a paper feeder including a paper feeding route for conveying an unprinted sheet, and a common conveyer configured to convey the unprinted sheet conveyed along the paper feeding route to the printing unit and convey the sheet with the front side printed conveyed along the circulation route to the printing unit; and a controller configured to control the printing unit, the paper feeder, and the circulation conveyer, wherein the circulation route includes a section in which the sheet with the front side printed is conveyed at a reverse conveying speed and transferred to the common conveyer, and the controller is configured in the duplex printing to:

determine the reverse conveying speed corresponding to the printing schedule based on a printing condition;

determine a switching timing corresponding to the printing schedule; and switch an operation of the common conveyer at the determined switching timing between a paper feeding conveying operation and a paper refeeding conveying operation, the paper feeding conveying operation being for receiving the unprinted sheet at a paper feeding conveying speed and conveying the unprinted sheet to the printing unit, the paper refeeding conveying operation being for receiving the sheet with the front side printed at the determined reverse conveying speed and conveying the sheet with the front side printed to the printing unit.

2. The printer according to claim 1, wherein the controller is configured to:

switch from the paper feeding conveying operation to the paper refeeding conveying operation at a first timing at which the sheet with the front side printed is conveyed at the reverse conveying speed over a first distance corresponding to the reverse conveying speed after the sheet with the front side printed reaches a first position in the circulation route located upstream of the common conveyer; and switch from the paper refeeding conveying operation to the paper feeding conveying operation at a second timing at which the unprinted sheet is conveyed at the paper feeding conveying speed over a second distance corresponding to the paper feeding conveying speed after the unprinted sheet reaches a second position in the paper feeding route located upstream of the common conveyer.

* * * * *